United States Patent [19]

Burstein et al.

[11] Patent Number: 4,685,534

[45] Date of Patent: Aug. 11, 1987

[54] METHOD AND APPARATUS FOR CONTROL OF FLUIDS

[76] Inventors: A. Lincoln Burstein; Roy Burstein, both of Box 608, 1810 Rittenhouse Sq., Philadelphia, Pa. 19103

[21] Appl. No.: 689,647

[22] Filed: Jan. 8, 1985

Related U.S. Application Data

[63] Continuation-in-part of Ser. No. 523,709, Aug. 16, 1983, abandoned.

[51] Int. Cl.[4] ..... F01N 1/02

[52] U.S. Cl. ..... 181/251; 181/223; 181/243; 181/268; 181/272; 181/274; 181/280; 181/282; 181/296

[58] Field of Search ..... 181/206, 223, 243–249, 181/251, 253–255, 262, 264, 268, 274, 279–282, 296, 272; 137/512, 574; 60/312

[56] References Cited

U.S. PATENT DOCUMENTS

| | | | |
|---|---|---|---|
| 981,584 | 1/1911 | Miller | 181/253 |
| 3,227,242 | 1/1966 | Mattoon | 181/245 |
| 3,399,597 | 9/1968 | Perrine | 181/223 |
| 3,412,825 | 11/1968 | Hall | 181/282 |
| 3,584,701 | 6/1971 | Freeman | 181/280 |
| 3,698,440 | 10/1972 | Matthien et al. | 181/227 X |
| 3,700,069 | 10/1972 | Rausch et al. | 181/280 X |
| 4,055,231 | 10/1977 | Martinez | 181/282 X |
| 4,222,456 | 9/1980 | Kasper | 181/280 X |
| 4,339,918 | 7/1982 | Michikawa | 181/279 X |

FOREIGN PATENT DOCUMENTS

| | | | |
|---|---|---|---|
| 358970 | 10/1931 | United Kingdom | 181/279 |
| 460148 | 1/1937 | United Kingdom | 181/280 |

*Primary Examiner*—Benjamin R. Fuller

[57] ABSTRACT

A basic new method and devices for treating flowing substances such as subdivided solids, colloids, gels, liquids and gases, under varying temperatures, pressure and velocity conditions is disclosed. The method is characterized by forming three concentric types of non-turbulent and unobstructed streams flowing essentially in one direction but differing in velocity from one another, the outermost of which is accelerated to become a surrounding jetstream flowing tangentially past reduced openings interconnecting with the other two types of streams, reducing fluid pressure in them until suction-effect at origin point results, and by final recombination of flows to produce a helically spinning accelerated vortical exiting thrust, to insure either virtually silent atmospheric gaseous discharge or energy-efficient pumping and optimally frictionless travel of liquids or flowing solids through extended conduit, for which devices are supplied by this invention.

19 Claims, 15 Drawing Figures

TYP I

TYP II

FIG 5 TYP I

TYP II

METHOD AND APPARATUS FOR CONTROL OF FLUIDS

RELATED APPLICATION

This application is a continuation in part of our copending application Ser. No. 523,709, filed Aug. 16, 1983 now abandoned.

BACKGROUND OF THE INVENTION

Any pressurized flowing gas, such as that exhausting from the operation of any type of fuel-burning or using engine—such as an internal combustion piston engine, jet or turbojet, diesel or turbine engine—will create sound at high decibels (volume) as it either flows past sharp edges, becomes turbulent, or rapidly expands into still air.

As a result, "noise pollution" has become a major source of concern to environmentalists, medicine, those involved in stress management, and the general public in our time.

Secondly, the pressure required to force such exhaust gases out of any type of engine and into the atmosphere creates a back-pressure and consequent power-drain upon the engine that results in direct reduction of delivered engine efficiency.

Thirdly, exhaust gases resulting from operation of any type of fuel-consuming engine (for example, an internal combustion engine) are known to contain products and by-products of incomplete combustion of fuels, such as carbon monoxide, lead, sulfuric acid and hydrocarbons, to mention only a few.

For example, total amounts of hydrocarbons present in the exhaust from an automobile may be as much as 1.2% by volume (that is, 12,000 parts per million) or more, while carbon monoxide concentrations may vary in amounts ranging from a fraction of one percent (1%) by volume, to as high as 10% by volume or more.

In internal combustion engines, average concentrations at idle conditions usually range between 6.0% and 6.5%. Therefore, desirability of somehow eliminating these high proportions of noxious gases from exhausted engine products remains of paramount importance—and grows more critical geometrically—and daily.

In fact, recent and worldwide recognition of the serious health hazards and genetic or reproductive mutations which the scientific community has discovered are engendered by air, soil and water pollution from airborne noxious products of auto and jet exhausts ultimately precipitating into our soil and water tables—particularly the hydrocarbon fractions responsible in part for the huge and unpleasant conditions known as "smog"—have painfully pointed up the critically serious nature of these pollutants.

These poisons have found their way into our bodies and have blocked off much of the life-giving rays of the sun to out planet—factors of critical concern to our survival.

Higher incidence of respiratory disease such as emphysema (resulting from carbon monoxide poisoning) and lung cancers have been found, by extensive demographic studies done in heavily populated and trafficked areas of the world, to be concentrated in such areas. It is therefore apparent that such incompletely burned exhaust gases and by-products are a form of deadly atmospheric contamination and must be eliminated as much as possible.

So long as fuel-burning engines are to be used, this object is only achievable by promoting the utmost complete burning of combustion engine products in all types of engines and in all ways possible.

This must be done immediately, practically and consistently, most particularly in our high performance engines of today which are being designed to operate best at maximum capacity that cannot be realized as a result of the poor exhaust equipment attached to them. This lessens complete realization of the combustive efficiency of an otherwise excellent engine, and produces pollutants otherwise unnecessary.

The above facts have tragically punctuated the needs for various and immediate concentration upon developing workable solutions.

While the art is replete with devices purporting to achieve this purpose, none appear yet to have achieved universal acceptance by either the public or automotive or aircraft engineers, in either internal combustion, turbine or jet applications.

In this application for letters patent, the inventors offer such a solution for all three of the above major problems—and more—in the preferred embodiments of their invention.

Present State of the Art

The inventors have noted several methods usually employed in dealing with either the twin problems of noise and back-pressure or the treating of exhaust gases, in general, from any type of engine.

One method has been either to exhaust the gaseous products of combustion through short stacks or conduits opening directly into a slipstream (as in fast-moving propeller-driven aircraft, using internal combustion engines) or through larger central conduits opening to discharge directly into the atmosphere (as done with jet, turbojet or rocket engines).

Another method is to route exhaust gases through an internally polished and "ported" manifold (one in which the passageways have been made as large in size as practical and made free of sharp bends which could cause turbulence) in order to reduce resistance to flow of burned gases from the engine exhaust ports to which a manifold of this type (usually called a "header" by hot rodders) is bolted.

Thence, from the manifold, gases are routed into a pipe leading into one of the various types of straight-through "mufflers", resonators or other apparati claimed to reduce back-pressure, which are usually filled with sound-deadening materials (as in glass-packed or steel wool-packed automobile mufflers for higher performance engines), and from there the gases are discharged through a tailpipe into the atmosphere as directly as possible.

Above methods, although somewhat effective in reducing back-pressure, do not eliminate it completely since back-pressure is still developed by collision of exhaust gases with surrounding atmosphere when they are discharged into it.

Thus engine power is still required—and thus drained—in order to pump exhaust gases out into the "air barrier" as they discharge. This is a factor in all direct—or more-or-less direct—methods of releasing exhaust gases into the atmosphere.

Further, in the so-called "header" or manifold type of exhaust treatment, employing a straight-through type of muffler or resonator, exhaust impulses from the engine overlap in the manifold (such as those from any multiple-firing engine), building up turbulence anyway, despite the finest "porting", relieving and polishing operations performed on its interior.

Such turbulence adds some back pressure from the exhaust system and appreciably reduces developed engine horsepower output as well as combustive efficiency.

Finally, even though all direct-release methods of exhaust treatment somewhat reduce back pressure, they generally are complete failures in the noise department, since considerable explosion noise is still released by any such systems.

The above "solutions" therefore, in actuality have been less than optimum for either noise or back-pressure problems.

Lastly we must note the more-or-less standard methods of exhaust treatment. These usually employ a manifold leading from an engine block (as in automobile or truck applications, for example) and bolted to its exhaust ports, which collects exhaust gases issuing from the engine and directs them into a pipe leading a standard muffler or resonator, and thence into a tailpipe assembly.

All of these components are designed to conduct the burned exhaust gases away from the engine and toward the rear of the vehicle for discharge into the outer atmosphere, while at the same time attempting to reduce the noise of combustion, expansion and rapid emission of gases before they enter the atmosphere. This is the standard "muffler" system.

In the present state of the art, mufflers are so designed that exhaust gases are forced through a series of baffles (designed to slow the speed of flow of the gases) and expansion chambers (designed to help partially cool the gases) and usually through some type of sound-absorbing material with which the "muffler" is packed, before they are discharged through a tailpipe into the atmosphere.

Most mufflers or resonators (some are combinations of both approaches) consist of a chamber or series of chambers having a larger cross-section and a larger volumetric capacity than those of the inlet piper. Within these chambers there may be a series of baffles designed to trap exhaust gases in a maze while they expand into the chambers.

Exhaust noise is thus attempted to be reduced through application of two laws of physics, namely that hot gases at high speeds make noise by expanding rapidly (called "explosion") and by making contact directly with a hearer through atmosphere continuous with the listener and the source of the sound, and within an auditory range.

Mufflers or resonators are therefore designed to counteract (1) the high speeds of exhaust gases, (2) their heat, necessitating expansion in order to cool, (3) potentiality of continuous atmospheric contact with anyone within an auditory range of distance, and (4) disturbing soundwave frequencies produced by motion of such gases.

The baffles in a muffler unit are designed to slow down the high speeds of exhaust gases (applying principle 1) which, though noise-reducing, creates turbulence in the muffler deliberately—deadening sound thereby, but adding considerably to total back-pressure. The baffles also function as a "heat sink" absorbing some of the heat from the gases, and thus reducing their need to expand somewhat, in order to cool.

Expansion chambers in a muffler, it is hoped, allow the gases to cool still further (applying principle 2) and thus reducing their noise potential in that way. However, due to the tortuous route the gases must travel to enter the series of chambers and the obstacles in their way of getting there (though deliberately and most often precisely placed), these chambers, though allowing the gases a place to go to expand, still do little or nothing to decrease back pressure. In operational fact, they increase it, since pressure is required to force the gases through the system.

Use of sound-deadening material in mufflers or resonators is designed to further isolate the sound producing qualities of the gases from any potential hearer (applying principle 3). This material does its job of course, but as well increases back pressure, since gases must be forced through it too, and since any interference, constriction or obstruction in the free flow of gases creates a back-pressure upon their point of origin: in this case, an engine.

Exhaust system designers have used these several principles for many years to cool exhaust gases and reduce the sound output of an engine. Heat conduction of the many surfaces in such a system also assists these above objects since cooler gases reduce in volume as they cool down. Advantages of the "muffler" are thus obvious and have led its widespread popularity into auto, truck, diesel and kerosene-powered vehicle applications. The "muffler" thus came—and stayed.

Along with the "muffler" however, came the problems.

In such mufflers or resonators, some of the gases—and their extremely corrosive by-products—remain in the apparatus, ultimately damaging it and requiring its replacement far sooner than almost any other component of a vehicle. So many nooks and crannies exist in the modern mufflers that it is a major source of worry for designers to combat internal rot in their systems, and "muffler-rot" is a constant source for stress for car owners.

Further, the extreme back-pressure problems produced by such systems, while deadening sound quite successfully in many cases, also increase most of the serious problems noted hereto—especially pollutants—since power-drain upon any engine causes it to burn its fuel less efficiently, thus creating more by-products to pollute the atmosphere when they are released into it. The millions of mufflers now in current use can be seen to present a formidable array of poison generators, threatening the entire planet.

It is thus clear that the use of any type of "muffler" or muffling (sound-deadening) devices designed up to now has been fraught with serious problems inherent to such designs or devices by their very nature of construction and basic principles of operation. It is also clearly an intolerable situation to continue their use without a better solution.

Straight-through types of exhaust handling systems, even though packed with absorptive materials, have failed to fully answer the back-pressure/pollution problems in a way we can all live with, since the end result is still fairly loud and creates enough "noise pollution" that in many communities there is considerably objection to their use and even local ordinances enacted prohibiting the "straight-through", or affording penalties for "excessive noise by automobile".

Moreover, as noted before, the "straight-through" type of system does not well eliminate back-pressure since some gas pressure is required even in these systems to force the gases through the packing and also to overcome the pulse-effect in the manifold, heretofore described.

Other negative considerations associated with "mufflers" of the baffle-type are that they increase and cause incompletely burned and unburned residues to lodge in the engine, lessening its longevity, as well as its operating effectiveness. This is another disadvantage in present-day systems.

From the foregoing, is is seen that any device attached to any engine to suppress its sound which causes back-pressure to develop is less than optimum. When the outflowing exhaust gases are forced back into the engine, it must compete against itself (as when in an internal combustion engine, exhausted gases are forced back, some may remain in the cylinder on the following intake and compression stroke, weakening the composition of the fuel/air mixture), thus preventing complete exhaustion from the engine, and diluting incoming combustibles.

Any interference or constriction of completely free engine breathing in any type of engine—whether it be piston-driven, jet or turbojet—will rob its full power potential, increase its fuel consumption and cause more wear, tear and corrosion on the engine and all its moving parts. Since recent fuel costs make it imperative to maintain a high operating efficiency in all types of engines, the problem of reducing or eliminating exhaust noise without impairing top efficiency becomes imperative to solve-now.

Yet in both straight-through or baffle-type "mufflers" air and noise pollution still remain major problems, to engineers as well as other people. In many communities ordinances outlawing straight-through "mufflers" have been passed.

High efficiency built into today's "high efficiency" engines cannot be fully realized in these times of concern for fuel shortages and high fuel prices primarily due to the present day exhaust-treating and muffler systems used.

Though exhaust-system designers have made many "improvements" on the standard systems, problems inherent in those systems themselves have remained. For instance, many of the "mufflers" made today have special layers of either aluminum, cadmium, lead or zinc alloy to protect them against corrosion from the elements, yet no matter how well protected externally, internal buildup and eventual clogging of the passageways of such a system render a nice surface into mere window-dressing, hiding an efficiency-destroying mess inside.

Because approximately a gallon of water is formed for every gallon of gasoline burned (for example, using an automobile model), most of the corrosion in exhaust systems occurs on the inside. Water produced by combustion of the fuel mixture as well as acids must pass through the systems, and will quickly rust its interior or corrode it. Until the system reaches operating temperatures, much of the moisture condenses on the cool surfaces, collecting there. As the muffler becomes hot, collected moisture tends to evaporate and may be forced out. Nevertheless, eddy spots and corners still collect some deposits of solids, and eventual buildup destroys efficiency.

Though engineers have found that such condensates boil at 202° to 210° F. and the mufflers must be operated at or above that temperature to expel some of their condensates, on short drives, the device will not reach that temperature and corrosion will still occur. To combat this effect most manufacturers are now using some form of rust or corrosion-resistant coatings or special alloys as described above in constructing their mufflers, to protect their interiors.

Stainless steel is being used, or a ceramic coating applied to interiors of mufflers and pipes. Even so, muffler and tailpipe replacement remain major factors in auto maintenance costs. It is because muffler design principles remain basically the same.

Some auto makers may use resonators as optical equipment to reduce vibrations and sound caused by the explosion and flow of gases. Although there is provision for expansion and cooling of exhaust gases to some degree in the designs of exhaust manifolds and pipes, much engineering has been attempted within the standards of mufflers and muffler systems above described, yet without totally overcoming their drawbacks. Sophisticated acoustical science still has had no better basic material to work with than the "muffling" concept of sound or vibration treatment.

For example, much skill has been employed in designing with engineering precision the size and shape of different chambers in mufflers to affect acoustical properties and attempt in that way to deal with or reduce back-pressure. In the last fifty years designers have indeed made some "improvements."

As a result, most types of modern mufflers include either (1) a Helmholtz tuning chamber, (2) a high-frequency tuning chamber, (3) a reversing-unit crossover passageway, or (4) combinations of the above.

The Helmholtz tuning chambers are designed to absorb resonance and reduce the noise level of exhaust gases in the system, but in practice are believed to primarily affect the lower frequency sounds. Nonetheless any closed chamber or partially closed chamber acts as a source of turbulence, ultimately generating back pressure, and may trap gases and residues, no matter how precisely designed to other purposes.

High frequencies, on the other hand, can be generated by venturi noise, such as is developed in a carburetor, or by exhaust flow passing over a sharp edge in the exhaust train, or by surface frictions between the forceful exhaust flow and the pipes. Generally, high frequencies show up as a whistling noise, so high frequency tuning chambers are engineered with inner tubes and perforations so that each perforation in the inner tube acts as a small tuning tube. Since turbulence and intersection of sound travel is the means by which the effect desired is gained in these methods of sound reduction, back-pressure—and more nooks and crannies to trap by-products—is still the result, together with all other evils heretofore described.

Reversing unit crossovers are most effective in reducing mid-range frequencies missed by the high and the low-frequency chambers. The amount of crossover is determined by the size and the amount of holes in the adjacent tubes. However, merely having holes and tubes plus the reversal of the gases in their travel through the system requires much pressure to accomplish such transit through the maze deliberately so designed. The result by now should be clear—and need not be repeated here.

Loss in engine power due to back-pressure has been well charted. In automotive applications, for example, for a given car speed, the loss in power increases very rapidly with the increase in back-pressure, so that with a 2 lb. back pressure at 70 mph, the power loss is 4 hp. With a back-pressure of 4 lb., power loss has increased 59.8 hp.

Similarly, fuel consumption is increased as "muffler" back-pressure increases, such that at 75 mph, back-pressure of 3 lb. will cause gasoline use of 0.116 gallons per brake horsepower per hour, but a pressure of 5 lb. will use 0.123 gallons, and at 9 lb. use will soar to 0.129.

In regard to exhaust system overall design, thorough care must be exercised to prevent kinks, flattened areas, restricted passageways or internal blockages, the weak link in the entire system—the "muffler" is by its very nature already a "blocked" design that is made deliberately to obstruct—or at least redirect in a turbulence-creating way—the free flow of exhaust gases. This makes life extremely difficult for muffler designers, and unnecessarily overcomplicated in dealing with the entire set of problems caused thereby.

Some designers may use a single muffler to reduce the noise of exhausts, others may use two mufflers in line or in parallel positions. The additional unit is sometimes called a resonator. But no matter how combined or re-named, a "muffler" is still an obstruction in the system, and the problems inherent in such a method cannot be done away with until this METHOD of treating exhaust itself is done away with and an entirely new approach is developed. Such an approach follows, in this application.

Lastly—and perhaps most importantly—exhaust systems, including "muffler" systems, must avoid leaks from occurring anywhere in an exhaust system since carbon monoxide (CO) gas is toxic and potentially lethal and must not be allowed to escape into the interior of any type of vehicle to sicken or kill the passengers or operator.

Since, as noted above, mufflers as well as tail and exhaust pipes wear out due to corrosion accelerated by outside factors such as rain, snow, humidity and salt on very icy roads, and inside factors such as decay and rust from pocketed water, friction, gases, acids and other corrosive fumes and by-products that develop within such a muffler system, a very real danger of escaping gas from a corroded unit or component of such units has given rise to its inclusion in all inspection procedures for land vehicles such as cars and trucks.

The problems above-noted offer clear explanation of the massive number of highway fatalities caused by drivers overcome by exhaust fumes from a corroded or faulty muffler-type system, during all the years they have been used in vehicles.

Yet to this day—despite a thorough patent search by the applicants—no noise-reducing, "muffling" or exhaust-treating system had been designed which was completely self-cleaning. And the critical problems resulting from the facts above remain to haunt us.

Even those who replace original equipment mufflers with brand new types realize that event the replacement's "days are numbered," and the replacement-muffler establishments are able to do a more brisk business than ever—while the real and pressing planet-wide problems caused by such equipment escalate to eventually fatal proportions for the human race.

And although vast amounts of sophisticated science and engineering skills have been applied to "improve" muffler and exhaust-system designs accompanying it, the basic principle of the "muffler" design has not changed in over three-quarters-of-a-century of "muffler" manufacturing.

Until now, with this application for Letters Patent!

HISTORICAL BACKGROUND FOR THE SCIENCE APPLYING TO THE BERNOULLI-PRINCIPLE EXHAUST SILENCER

The method we have invented to remove and silence exhaust gases produced by any and all types of fuel-combusting engines and to eliminate the noise made by their expansion and cooling employs two principles involving the sciences of compressible gases and fluid dynamics, as set forth first by Daniel Bernoulli (born Feb. 8, 1700; died Mar. 17, 1787). In his scholarly work, *Hydrodynamica,* Bernoulli first stated to the world in 1727, in an article in the above work, entitled "Theoria Nova de Motu Aquarum per Canales Quoscunque Fluentium", the nature of these principles of fluid flow. More than two centuries ago, he was the first researcher to apply mathematical analysis to the problems of movements of fluid bodies.

In designing our apparatus, we have carried forward the laws of physics Bernoulli enunciated for liquids (fluids) and have applied them to gases, which are considered properly by modern physicists as merely another form of fluid or viscous matter. A fluid is a state of matter in which only a uniform isotropic pressure can be supported without indefinite distortion; so, a gas or a liquid.

The distinction between highly viscous liquids and solids is a difficult one, the same material acting as an ordinary liquid under some circumstances and as a solid under others. One example is water, which parts nicely for a swimmer moving through it, but is quite solid when hit by an inexperienced diver doing a belly-flop from a high board. Another example is oil, a highly viscous fluid which lubricates quite well and can flow quite smoothly ordinarily, but which becomes quite solid when confined to a hydraulic brake cylinder or an automotive shock absorber cylinder.

Fluids may be described in various ways. A perfect fluid is frictionless offering no resistance to flow except through inertial reaction. A homogenous fluid has the same properties at all points. An isotropic fluid has local properties that are independent of rotation of the axis of reference along which those properties are measured. An incompressible fluid is a fluid whose density is substantially unaffected by change of pressure. The behavior of a real fluid is similar to that of an incompressible fluid only if the pressure variations in the flow are small compared with the bulk modulus of elasticity.

An elastic fluid is a fluid for which elastic stresses and hydrostatic pressures are large compared with viscous stresses. A viscous fluid has an appreciable fluid friction. A Newtonian fluid is a viscous fluid in which the viscous stresses are a multiple of the rate of strain. The contact of proportionality is the measure of the fluid viscosity.

Viscosity is a property of fluids which appears as a dissipative resistance to flow. The term dissipation has three related uses in physics, as follows: 1. The interaction between matter and energy incident upon it, such that the portion of the energy used up in the interaction is no longer available for conversion into useful work. 2. A persistent loss of mechanical energy because of the presence of frictional or frictionlike forces. 3. In free oscillatory motion, a persistent loss of mechanical energy due to presence of frictionlike resistence to motion which eventially exhausts the total energy of the system and causes it to come to rest. Such motion is said to be damped.

Just as there are many types of fluids, so there are, partly as a result, many types of fluid flow, necessary to understand, in order to appreciate fully the mechanics of the processes present in our apparatus. Uniform flow is steady in time, or the same at all points in space. Steady flow is flow of which the velocity at a point fixed with respect to a fixed system of coordinates is independant of time. Many common types of flow can be made steady by a suitable choice of coordinates. Rotational flow has appreciable vorticity, and cannot be described mathematically by a velocity potential function. This factor we will encounter heavily in the following discussion applied to our device. Turbulent flow is flow in which the fluid velocity at a fixed point fluctuates with time in a nearly random way. The motion is essentially rotational, and is characterized by rates of momentum and mass transfer considerably larger than in corresponding laminar flow. Laminar flow is flow in which the mass of fluid may be considered as advancing in separate laminae (sheets) with simple shear existing at the surface of contact of laminae should there be any difference in mean speed of the separate laminae. If turbulence exists, its effect is confined to a lamina, and there is no exchange of momentum between laminae. Streamline flow is flow in which fluid particles move along the streamlines. This motion is characteristic of viscous flow at low Reynolds numbers or of inviscid, irrotational flow. (Reynolds number is a dimensionless number that establishes the proportionality between fluid inertia and the sheer stress due to viscosity. The work of Osborne Reynolds has shown that the profile of fluid in a closed conduit depends upon the conduit diameter, the density and viscosity of the flowing fluid, and the flow velocity.) Secondary flow is a less rigorously defined term than many of the foregoing types of flow. The flow in pipes and channels is frequently found to possess components at right angles to the axis. These components which take the form of diffuse vortices with axes parallel to the main flow form the secondary flow. Three types may be mentioned: 1. Secondary flow in curved pipes or channels, being a motion outwards near the flow center and inwards near the walls. 2. Secondary flow in straight pipes and channels of non-circular section, being a motion along the walls toward corners or places of large curvature and from there to the center of the flow. This only occurs in turbulent flow. 3. Secondary flow in pulsating flow. This is due to second order effects and is particularly striking with ultrasonic waves.

A particular type of laminar flow which deserves special attention when observing fluid flow is called the boundary layer. In a fluid of low viscosity (the ability of a fluid to conform or resist elastic distortion stresses, its dissipative resistance to flow), such as air or water, motion of such fluid around a stationary body or through a stationary conduit possesses the free velocity of an ideal fluid everywhere except in an extremely thin layer immediately next to the stationary body.

Simply discussed, a laminar flow of a fluid, or gas with fluid properties, would be one in which layers of the fluid slide upon one another in a direction parallel to the axis of flow. This effect, and the force which produces it, is called shear. A force that lies in the plane of an area or a parallel plane is called a shearing force. It is the force which tends to cause the plane of the area to slide on the adjacent planes.

An example often used to describe this property of fluids in graphic form would be to envision a large municipal telephone book, viewed edgewise as it is being flexed undulantly. The edges of the many pages are seen to slide and flow in an undulant pattern upon one another in illustration of wave form.

This effect may be made even more easily apparent if a few vertical lines in contrasting ink are drawn upon the edge of the book facing the observer and the flexing experiment is then repeated. What is called the shear pattern will then emerge and the lines will be seen to shift in directions angular to the axis of flow as the flexes continue and will curve with the flow of the layered pages. This experiment illustrates laminar (layered) flow.

Since a boundary layer is a particular type of laminar flow only existing in a very thin layer (usually a few thousandths of an inch) immediately next to the stationary body or surface in a moving fluid, several of the factors which may alter its pattern must be considered, in order to evaluate its effect in relation to our device.

Important factors in fluid flow analysis are the viscosity of fluid or the dissipative resistance of an incompressible fluid to alterations in its perfect flow pattern (the free velocity of an ideal fluid) which may result from any stress at angles to the axis of that flow pattern, and the density of a fluid or its mass per unit volume, usually expressed in grams per centimeter). The density of any body is the ratio of its mass to its volume.

Other important factors include a fluid's compressibility. Compressibility of a gas is defined as the rate of volume decrease with increasing pressure, per unit of volume of the gas. Compressibility depends not only on the state of the gas but also on the conditions under which the compression is achieved. For example, if temperature is kept constant during compression, the compressibility so defined is called isothermal compressibility. If the compression is carried out reversibly (without heat exchange with the surrounding gases) then adiabatic compressibility is obtained.

The degree of turbulent flow must also be considered in any device designed to treat flowing gases or fluids. In a turbulent flow, the incompressible fluid, or an intrinsically compressible fluid such as exhaust gases, which are not subject to compressive circumstances in a particular example, has velocity components abnormal to as well as parallel to the axis of the conduit in which it flows.

Turbulent flow has been likened in appearance to that of a large railway station during the commuter rush hour; people skirt about in a all different directions, but the general flow is toward the gate which leads to the train.

In fluid terms, this effect illustrates that there is a difference in velocity and direction between particles of an incompressible fluid (or intrinsically compressible fluid, under circumstances as described above) which are stressed by certain conditions.

To determine any undulant laminar flow pattern, or shear pattern, existing in a fluid under conditions as described above, one must take into account any stress factors affecting it along at least two length dimensions: those along its axis of travel and those at angle to that axis.

Viscous effects at the boundary or walls of the conduit can also retard the fluid motion and, in fact, when measured at the molecular level, the velocity of a fluid in motion is zero immediately adjacent the walls of a conduit. This is the result of friction of the fluid molecules with those of the conduit wall. The distance into the fluid stream in which the decelerating effects of wall friction are evident is what comprises the boundary layer.

Velocity differences in related laminae and layers of any flowing fluid mass is affected by the character of the conduit. Important factors are its size and dimensions along the flow path, its shape and the character of the surface with which the fluids must come into contact and therefore friction.

As the length of the flow path increases, the thickness of the boundary layer also increases, since turbulence builds geometrically as more molecular particles are immobilized as they are crowded along the succeeding areas of the walls of the conduit. Again, it is very much like the railway station where, as the crowd enlarges, more milling about may be seen as more would-be passengers are pinned against the station walls. With sufficient length of the flow path, or sufficient friction against the walls of the conduit, the boundary layer will fill the conduit completely. In other words, in our railway station analogy, there will be Standing Room only. The entire crowd will be standing still, jampacked, immobile.

A similar effect is produced where particles of an incompressible fluid must flow through a smaller aperture than that flowing through a larger volumetric area and contiguous contact exists between the main mass or body of fluid and the sub-body flowing through the smaller aperture. Difference in velocity between the two masses is proportionately higher relative to the relative size difference between the smaller aperture and the larger area, factored by the total amount of mass which must flow through the smaller aperture at any given instant, and taking into account intrinsic factors of the fluid such as viscosity, compressibility and density indices.

All factors considered, the boundary layer, and thus turbulence, may thus extend into the main flow more in a smaller aperture while friction against the walls of that aperture increases; since in a flowing homogenous mass (one of more or less constant volume and density) such as exhaust gases after their ejection from an engine's combustion chamber, the velocity or rate-of-flow increases proportionately to the decrease in size of aperture through which the mass must flow, relative to the total volume/density ratio of the homogenous mass that flows through it, according to Bernoulli's well known mathematics. Subject to the limitation that the apparatus must be at least large enough for the particles or molecules of mass to pass through it, the law may be stated simply: the smaller the hole, the faster the flow (of a homogenous fluid mass).

The basic features of the different flow regions in a Newtonian turbulent boundary layer along a smooth surface are: a viscous sublayer, a transition layer and a portion of the turbulent layer, which together form an inner or wall region.

The flow in this region is determined by the fluid density and viscosity (ability to resist alterations induced by stresses from its ideal free flow pattern) as well as the wall shear stress, or coefficient of drag: the capacity of the wall character to induce drag on the fluid.

In the boundary layer, production of turbulence kinetic energy is almost in equilibrium with viscous dissipation, except very close to the wall where dissipation is greater than production, and that difference is compensated for by turbulence diffusion of pressure energy from the wall-rebound vectors (rebound energy induced by collision of the fluid with the wall).

Most of the production and dissipation of turbulent energy takes place in this region. Viscous vortices ("stickiness" in a fluid which makes it normal free-flow pattern curve or "shear") in the transition layer grow, then break up into new vortices, which then diffuse into other layers. These are the mechanics of turbulence.

It should suffice to note that laminar (layered) flow as well as the degree to which it is turbulent have a significant effect upon the degree of engine exhaust back pressure build-up in the flow through any system of the particular type of fluid termed "exhaust gases." It is treated herein quite exhaustively, in order that the motive for and nature of the principles we have designed in the device will be shown to be clearly related to the following detailed descriptions of the structure and method of manufacture of the apparatus, both factors of which are essential to guarantee the effects sought by the inventors.

Bernoulli's law, therefore, in its usual form, and in view of the foregoing definitions, applies to the steady flow of an incompressible fluid, and applies to the law of conservation of momentum as expressed in fluid flows. It can be expressed in and obtained by integrating the Navier-Stokes equations along a streamline (a line of flow expressed mathematically; laminar flow). The inventors do not include these mathematics herein since it is felt that any competent engineer familiar with the laws of fluid dynamics may compute particular examples as needed for himself. Secondly, the fluid relationship may be expressed verbally quite adequately enough to be well grasped by anyone versed in the art, as we have done above.

Therefore, according to Bernoulli's mathematics, the law states, in basic terms, that any incompressible fluid (which may be either liquid or gas not being subject to compression in a particular circumstance, or a mixture of both) when it is squeezed through a decreasing aperture or narrowing passage of flow, and the mass remains constant, must increase its flow rate or velocity of passage to pass through the narrowing aperture; the increased velocity of the primary mass will also cause a consequent or resultant decrease in pressure upon any ambient or surrounding fluid mass, provided the surrounding mass is contiguous or in communication with the higher-velocity fluid so treated as above described.

In other words, increased flow speed in a restricted area of a pipe or conduit wherein a fluid is flowing will cause a consequential decrease in pressure in other less or non-restricted sections of the same or connecting conduits.

If the velocity differential between the two contiguous masses is marked, a suction-effect upon the lower-pressured mass will result. An illustration of this effect easily constructed is a common drinking straw placed in a glass of fluid vertically, which then has a high-speed jet of compressed air applied across its diameter open to the atmosphere and opposite to the end placed in the water. The fluid will be observed to rise in the straw, illustrating suction in the tubular straw.

The reduction of pressure in the body of the straw causes the liquid to be forcibly drawn into it and toward the more rapidly moving stream of air across the tube at the top.

Another illustration of these principles or laws of fluid dynamics is the airfoil effect upon any typical airplane wing.

It is well known to aircraft designers that air moving past the upper or curved surface of a wing will increase its flow rate in order to get around the curve, and thus cause a resultant decrease in pressure in the surrounding air and upon the upper surface of the wing. This causes the normal air pressure against the lower surface of the wing to be in enough differential between the lowered pressure on top to cause the characteristic "lift", which causes the aircraft either to rise, or support itself in flight, against the pull of gravity.

These principles also apply to the phenomenon of increase of airflow speed around the moving impacting side of a baseball thrown with a spin. This produces a decrease in pressure in the surrounding air, thus a differential between the impacting surface side of the ball and the opposite withdrawing surface side of the ball, which has normal air pressure, and thus is seen the resultant "curveball" effect upon the ball's trajectory.

The principles are also used in streamlining effects designed into aircraft and automobile bodies such as "spoiler" surfaces, in tool designs such as compressed-air jet nozzles for such uses as sandblasting, spray-painting and compressed-air cleaning tools for automotive mechanics or auto body repairs, and the high-speed nozzles used by firemen, etc.

The above-illustrated two basic Bernoulli principles, and those regarding boundary and turbulent laminar flows, are the foundational principles around which the present embodiments of this invention have been designed. The inventors feel that our applications of the above enumerated principles apply basic laws of fluid dynamics, which in themselves are undeniably in widespread uses as shown above, that have never been explicitly applied in just the ways embodied in our device, for just the purposes described in this application, or to produce the effect or effects as claimed herein.

In light of these considerations, the inventors present that this application should be determined as that for a basic and original patent.

SUMMARY OF THE INVENTION

This invention has been designed as a method to treat various types of liquid, gases or flowing solids, all classed in physics as fluids, with specific applications improving the efficiency of all types of combustion engines and eliminating noise, vibration and pollution from the exhaust gases of combuation fuel burning engines, products of which are significantly being produced and ejected into the atmosphere by prior types of the sound-suppression systems now in operation. Additional applications of the method shown, without substantial alteration, may include control of oil in drilling operations, in explosion silencing apparati, and applying the device as a jet engine with no moving parts or motionless turbine and as a fuel or other compressible fluid control or compression device.

By means of the embodiments described herein, the operational effect of any type of combustion engine can be vastly improved without regard to the variety of operational or driving conditions imposed upon the engine, while at the same time decreasing consumption of fuel and improving the engine combustive efficiency.

This process and apparatus will protect the environment from both noise and unburned fuel pollution at significant levels as this device becomes widely employed.

A salient feature of the applicants' invention is the manner in which the exhaust system functions so as to accomplish the above objects and simultaneously therewith actually increase engine horsepower output over that which is developed using priorly disadvantaged methods described herein.

Acoustic characteristics of this device and the process of treatment of gases flowing within it result in elimination of sound at both the high and low as well as mid-ranges of the sound spectrum, therefore covering the complete range of frequencies.

Although this device retains the sound absorptive characteristics formerly achieved by use of internal packing with sound-deadening—but turbulence (and thus back-pressure) creating—material (usually either metal wool or fiber glass packing), this invention offers none of the disadvantages of earlier method types. For instance, in eliminating the need for any type of packing, the device eliminates the breakdown of muffling material itself from heat or moisture buildup within the body of such a packed unit, or corrosion to the body resulting from trapped matter. The device also eliminates back-pressure buildup to whatever degree from any turbulence formerly created by gases flowing past surfaces or edges within prior types of exhaust treatment units.

Instead, this invention absorbs sound in an entirely new way, employing novel principles of physics and fluid gas dynamics, and creates other entirely new benefits as enumerated herein.

Of major note is the fact that not only is preliminary back pressure avoided by this design, in that no requirement exists for engine power to be diverted in order to pump out exhaust—as normally is the case in prior systems of exhaust handling—but in the present embodiment of this device forces of eduction are actually produced here (by drawing forth of gases) within the system. These forces tend to draw off the gases more rapidly than would be accomplished by engine pumping or simple gas expansion. In short, the device produces a "negative back-pressure" or partial vacuum-effect upon the exhaust charge ensuing from engine operation.

Additionally, deflection cones or a single continuously wound helical deflection surface—in both types, of varying pitch—insure the one-way vector of gas flow and acoustic communication between chambers of the device, resulting in sound elimination through the widest range of frequencies and amplitude, rendering any type of damping or resonance chamber unnecessary. Thus, their absence in this device insures the turbulence-free process of gas treatment and the partial vacuum created by operation of this design creates a negative back-pressure, instead of merely redcuing it, as had been the practice in prior methods of exhaust treatment.

The device also eliminates turbulence-related noises and vibrations otherwise induced by vortices created by and along the surfaces and edges of prior types of muffling apparati. This device is structurally designed to eliminate internal gas-flow turbulence and also to eliminate surface-drag turbulence by polishing the interior wall of the outer-shell, where gas-flow velocity is highest, and all other internal surfaces.

This also results in longer life of the unit with less wear being created by gas or molecular friction upon the internal surfaces, reduces internal resonance-frequency creation, and thus improves sound-handling characteristics to optimum, as well as improving efficiency of the designed process to its maximum.

The present embodiment avoids all obstructive effects upon the freest passage or expansion of exhaust gases, in that it comprises a central longitudinally open conduit with numerous radial perforations polished on all surfaces and edges; expansion chambers aerodynamically designed to be turbulence-free, for unobstructed expansion of incoming gases flowing through the perforate inner conduit; apertures for smooth transfer of gases from the expansion chambers into a jet-flow gas stream, which then creates a suction-effect upon the gases within the transfer chambers; and polished surfaces throughout to eliminate surface-friction turbulence.

In either embodiment of this invention, a final process is included which imparts a spin, torque or vortex-effect to the entirety of exhaust gases flowing through the device (rather than a partial vortex attempted heretofore). This effect is accomplished by means of a helically finned and aerodynamically-designed "torpedo" which is also fully surface-polished. This causes and permits free conduction and circulation of gases through and out of the device without creating added resonance within the device itself, and permits rapid and soundless discharge of gases to the surrounding atmosphere.

It is thus evident that the applicants' exhaust system will effectively eliminate exhaust noise level while actually appreciably increasing the developed (or crankshaft) horsepower, or, as in the case of turbine or jet engines, will increase the respective horsepower of the engine itself, at point of power delivery.

BRIEF DESCRIPTION OF THE DRAWINGS

The features and advantages of the invention will become apparent from the description following, taken in connection with the accompanying drawings illustrating various typical embodiments of the devices, herein.

DESCRIPTION OF THE PREFERRED EMBODIMENTS OF THE INVENTION

Figure 1:
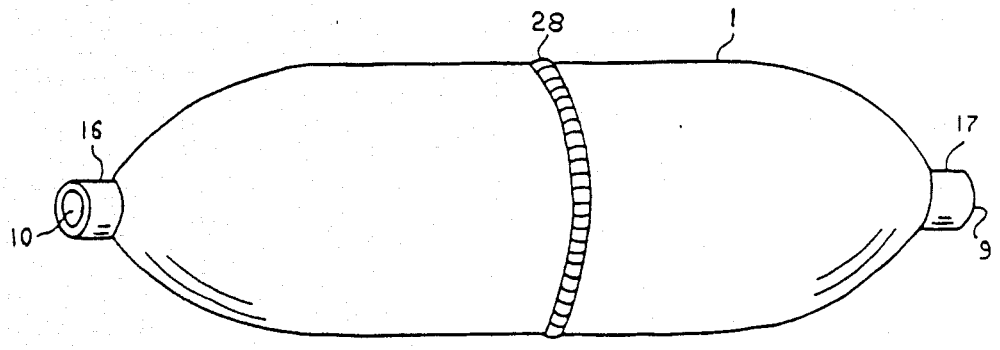
FIG. 1 is a perspective view of the fluid control device depicting a typical embodiment as an entire exhaust silencer, showing the outer protective shell which houses the inside assembly. The outer shell and inside assembly together carry out the functions of our invention.
Figure 2:
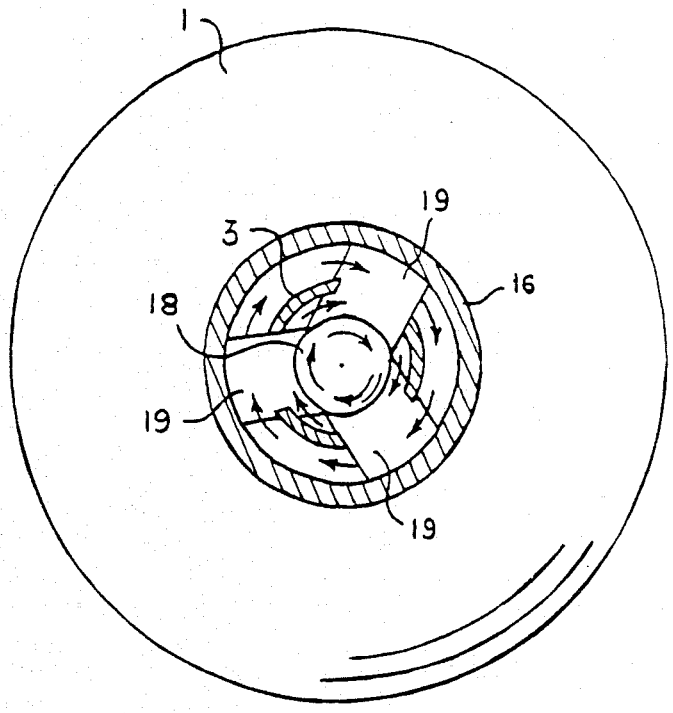
FIG. 2 is an end view of the exhaust end of the device, depicting the exhaust-end tunnel through which is seen the torpedo and its vanes in their action upon exhausting gases as they exit through the tunnel formed by the inner and outer shells, and thence into the atmosphere or tailpipe (not shown).

A general description of our Bernoulli- and suction-effect fluid control method exhaust silencer is given in this application for letters patent by reference to FIGS. 1 to 10, as follows:

The exhaust silencer system FIG. 1 in its preferred embodiments, shall appear as pictorially depicted. The two models to be explained herein (TYP I and II) are identical in their outer appearance, as shown in FIG. 1, illustrating an outer protective shell body 1 or housing, cylindrical through its major longitudinal portion, of circular cross-section, narrowing longitudinally in a double curve at each end to approximate the outside diameter of centrally placed and longitudinally extending tubular bushings formed at both ends.

The outer housing is bound to the bushings, thus forming the characteristic appearance of the entire unit. Though it is circular in cross-section in the preferred embodiments, the device shall not be limited to this outward shape alone. The unit may, for example, be ovular in such particular or specialized applications as in an automotive exhaust system for a low-slung small car, etc., or altered for other uses, so long as it does not depart from the spirit and principles as embodied in this application.

The outer housing serves as a means for protecting the internal assembly parts of either TYP I and II of the device. Its integral form is designed to house the internal assembly parts and to both enclose and form a dead-air and partial vacuum space, as a means to implement the sound-elimination purposes of the invention.

FIGS. 3, 4, 5 and 6 show the outer protective shell or jacket to be comprised of two layers of material, the inner of which may be either heavy-gauge steel or any other type of rigid, impact-resistant material such as spun-filament and spin-layered fiberglass or other synthetics recently developed to meet similar needs by the aerospace industry and others, and an outer layer formed by coating and bonding to the inner rigid layer portion of the shell of a number of recently developed non-rigid, adhesive, weather, acid and corrosion-resistant materials, which also contain the property of resiliency, or of "giving" against an impacting force. The outer layer will thus absorb and return any random impact, "bouncing" it away from the inner rigid layer and redirecting any impact sustained by the device, as a means of preventing any denting or distortion of the shape of the inner layer or any impact damage to the inner assembly parts.

The outermost coating material, as well as the inner more rigid layer of the shell shall also be variable as to thickness and material, thus allowing durability and resiliency characteristic of the entire protective housing to be altered to fit anticipations of likely stresses to be encountered in particular applications to which the device will be adpated by its users or manufacturers. Thus, by simply varying the thickness and/or material of either or both the coating comprising the outer layer and/or the rigid inner layer, the widest range of applications and needs are feasibly met.

Internal assembly parts of the device are comprised of an intermediate imperforate housing, tubular through most of its longitudinal portion, of circular cross-section, with its end portions integrally narrowing through double parabolically curved slopes (concave-to-convex at the intake end and convex-to-concave at the exhaust end) toward the outer diameter of a central tubular member and affixed thereto at the intake end of the device. The outer surface of the intermediate housing is bound to the outer housing at their intake ends, forming a circular opening as a means to permit a pressure fitted insertion of the intake extension of a central tubular member which forms an intake end bushing which may serve as attachment means to an engine.

A complete description of the Bernoulli and suction-effect exhaust silencer is given in this application by referring to FIGS. 1 to 10, as follows:

The silencer system FIG. 1 in its preferred embodiment comprises: an outer protective shell 1, an intermediate shell or tubular housing 2 narrowing at both ends and forming a silencing chamber 6*a*,6*a*′ a central perforate (or porous) tubular member 3, (FIGS. 3 and 5) or 3′ (FIGS. 4 and 6) either a series of double parabolically formed conical deflection surfaces 4 (FIGS. 3 and 5) or a single continuously wound helix double parabolically formed and rearwardly angled deflection surface 4′ (FIGS. 4 and 6) which in both models (TYP I and II) are attached at their innermost edges to the inner tubular member 3,3′, and a helically finned 19 final gas-deflecting "torpedo" 18 (FIGS. 3, 4, 5 and 6) placed at the exhaust end 10 of the device. At the intake end 9 of the apparatus, the central tube 3,3′ extends longitudinally to form a bushing 17 for connection to an engine, while at the exhaust end 10 of the device, the intermediate housing 2 longitudinally extends forming both a tunnel 16 for conducting vortexing gases exiting the device and an exhaust end bushing 16 adaptable for connection to other standard means for exhausting gases into the atmosphere (such as a tailpipe in automotive applications, for example, but not limited only to such adaptation).

The apparatus is assembled as follows: The outer protective shell 1 surrounds and encloses the intermediate housing 2 and is so formed as to create a dead-air space 1*a* between the inner surface of the outer shell 1 and the outer surface of the intermediate housing 2. The outer shell 1 is separable into two halves (FIGS. 3, 4, 5 and 6) which are joined by means of fitted and matched compression grooves 28 cut into the rigid material comprising the impact-resistant layer 29 of the outer shell 1.

Sealant 28*a* is then applied to a hemispheric channel 28*b* circumferencing the outer diameter of the shell 1 and formed by partially cutting into the harder inner layer 29 of the outer shell material and molding the channel into the outer corrosion and impact-resistant coating 29*a*, as shown in FIGS. 3, 4, 5 and 6.

A vacuum-exhausting valve 30 is fitted in the outer shell 1 as a means for exhausting the air between the intermediate housing 2 and the outer shell 1 to create the partial vacuum effect or dead-air space 1*a* as a means of eliminating conducted sound generated within the interior of the device when assembly is complete and the apparatus is in operation.

An inlet-end bushing 17 is formed by longitudinally extending the central tube 3,3′ and an outlet-end bushing 16 is formed by longitudinally extending the intermediate housing 2 as a means for attaching, at each end, the two separating halves of the outer protective shell or jacket 1 (FIGS. 3, 4, 5, and 6).

At the intake end 9, the outer jacket 1 intake-end half or section (FIGS. 3, 4, 5 and 6) is attached to the central tube bushing 17 and the intermediate housing 2 by means of integral forming of the outer jacket 1 narrowing to an opening which fits flush with the intermediate housing 2 intake end and the outside diameter of the central tube 3,3′ and then compression-fitting it over the central tube 3,3′ and against a shoulder 21 formed on the outside diameter at the intake end of the central tube 3,3′. This permits gas-tight coupling of the two shells at the intake end 9 and evacuation of the dead-air space 1*a* at that end to remain intact.

At the exhaust end 10, the outer surface of the gas-conducting tunnel or bushing 16 is threaded 26 to accommodate matching threading 26 cut into the inner surface of the exhaust-end half or section of the outer shell 1, which also narrows in similar fashion to its intake end 27. This joining permits gas-tight coupling of the two shells at the exhaust end 10.

The intermediate tubular housing or inner shell 2 is an imperforate cylinder of larger diameter throughout most of its axial length, narrows in a double parabolic curve at both ends 14,15 to approach or approximate the outside diameter of the inner tubular member 3,3′, is attached to the intake end 9 by means of a compression-fitted opening 27 formed integrally at its intake end 14 and compressed over the central tube 3,3′ to rest against the gas-coupling shoulder 21 formed on the outside surface of the central tube 3,3′. At the exhaust end 10, the intermediate housing 2 forms integrally the final exhaust tunnel and bushing 16 and serves as a means to house and affix the final "torpedo" 18 by compression against its helical fins 19.

The intermediate housing 2 has an aerodynamically designed inner surface polished to facilitate smooth, non-turbulent gas flow, and forms integrally a silencing chamber 6*a*,6*a*′ whose walls diverge from convex to concave at the interior of the intake 14 and converge from concave to convex at the interior of the exhaust end 15 to approximate at either end the diameter of the central tubular member 3,3′. The exhaust end tunnel and bushing 16 of the intermediate shell 2 may vary in proportions to fit individual applications, as makers and users may determine, or to fit connection to exhaust systems of the various types of engines for which this invention is designed to universally apply.

The intermediate housing 2 in both TYP I and II (FIGS. 3, 4, 5 and 6) is formed in three sections consisting of an imperforate cylindrical or tubular enlarged mid-portion 2*a* comprising its main body and two end portions 2*b*, 2*c* reducing in diameter through compound curves as described above toward each end to approximate the diameter of the central tubular conduit 3,3′ forming the inlet bushing 17 and to form, at the exhaust end 10, an exhausting gas conduction channel 16 as an integral formation of the exhaust-end section 2*c* to direct the vortical gas flow exiting the devices.

Assembly of the intermediate housing 2 is accomplished by threading of the inner surfaces of the middle portion 2*a* at both intake and exhaust facing edges 26 and the outer surfaces of the centrally facing edges 25*a* of both intake and exhaust-end sections 2*b*, 2*c* of the intermediate housing 2, as a means to accommodate installation, servicing or replacement of the enclosed inner working parts of the device. The three parts of the intermediate housing 2, 2*a*, 2*b*, 2*c* can thus be assembled in the same fashion in both TYP I and II and are universally interchangeable in both models.

By means of this feature above described, the conversion, updating or installation of any improvements in design which embody the principles or ideas unique to this invention is facilitated and the inclusion of any developments in the art which embody any features of this invention or the ideas of the inventors is secured.

FIGS. 3, 4, 5 and 6 show that disposed radially about the internal gas-conducting central channel 3,3′ and affixed to it at their centrally disposed or inner edges are either a series of axially diverging and angled cones 4 (FIGS. 3 and 5, TYP I) expanding radially in diameter from their bases affixed to the central tubular member 3 and extending toward the inner surface of the intermediate housing 2 which angle posteriorly toward the exhaust end 10 of the device, or a single axially diverging and angled continuously wound helix 4′ (FIGS. 4 and 6, TYP II) similarly diametered. Cones 4 and helix 4′ in both TYP I and II are unfixed at their radially outer edges.

Each cone 4 or the helix 4′ extends radially from the central tube 3,3′ so as to approach closely the inner surface of the intermediate shell 2 as a means of forming either a series of gradually narrowing apertures 5 between the outer edges of the cones 4 and the intermediate housing 2 or a single continuously running graduatedly narrowing aperture 5′ between the outer edge of the helix 4′ and the inner surface of the intermediate tubular housing 2 in TYP II.

Both the series of cones 4 or single helix 4′ (TYP I and II, FIGS. 3, 4, 5 and 6) are formed so that their surfaces present a double parabolic curve expanding radially from concave to convex from the base affixed to the central tube 3,3′ and angled axially toward the exhaust end 10 of the device, as a means to direct the flow of exhaust gases in accordance with the principles embodied within the device and described herein.

As a result of the angular approach of the unfixed outer edges of the cones 4 or helix 4′ to the inner surface of the intermediate housing 2, either a series (in TYP I) of Bernoulli-type apertures 5 (FIGS. 3 and 4) or a single continuous helical aperture 5′ (FIGS. 4 and 6) running axially the length of the inner surface of the intermediate housing 2 are formed between the cones or helix 4,4′ and the intermediate shell 2.

In either TYP I and II, the deflector(s) 4,4′ act as a means for conducting exhaust gases toward the inner wall of the intermediate housing 2 and radially away from the central tube 3,3'. The diminishing passages 5,5' toward which the gases are conducted then act as a means for increasing the velocity of combining gases entering the passages 5,5' and thus creating the Bernoulli and suction effects characteristic to the device.

Figure 4:
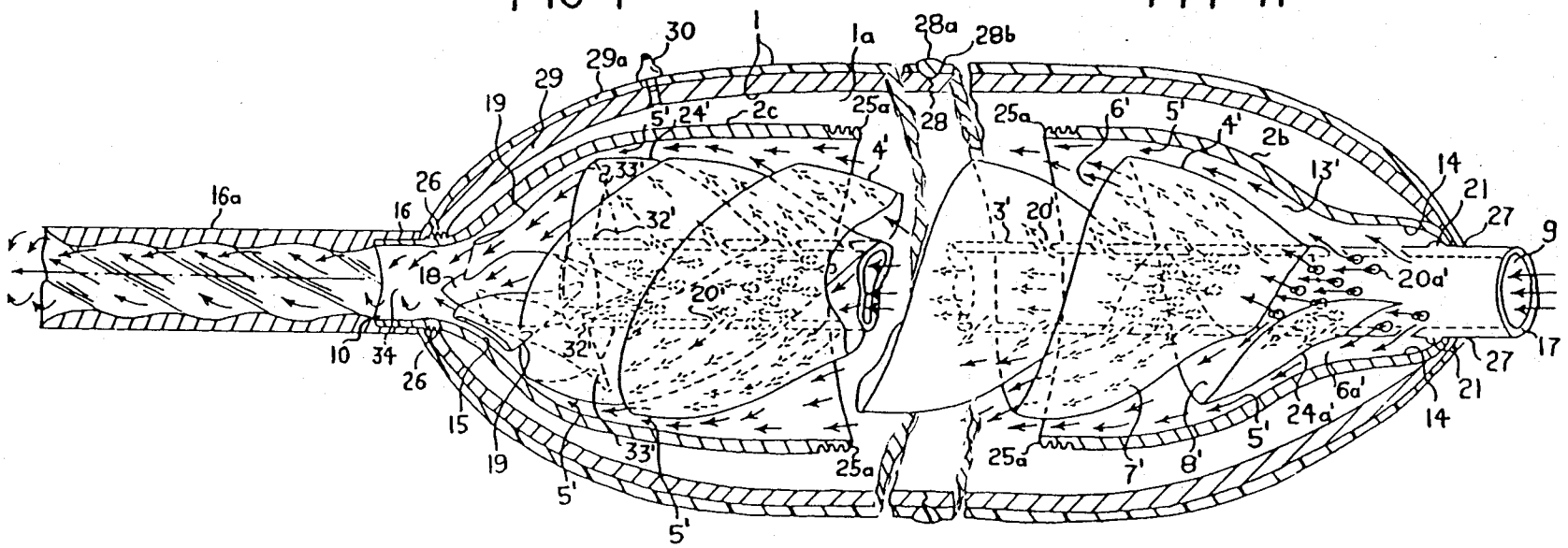
FIG. 4, TYP II is a similar schematic illustration of the details of the second of the preferred embodiments of the silencer, herein entitled TYP II, with its attached vortex conduction tunnel extension depicting similar gaseous travel paths as they are affected by the helical design of this embodiment, illustrating the vortical effect upon the entire mass of gases within the body of the device, which increases the Bernoulli and suction-effect upon them before they reach the final end vortical-motion-imparting torpedo-and-vane arrangement common to both embodiments.
Figure 6:
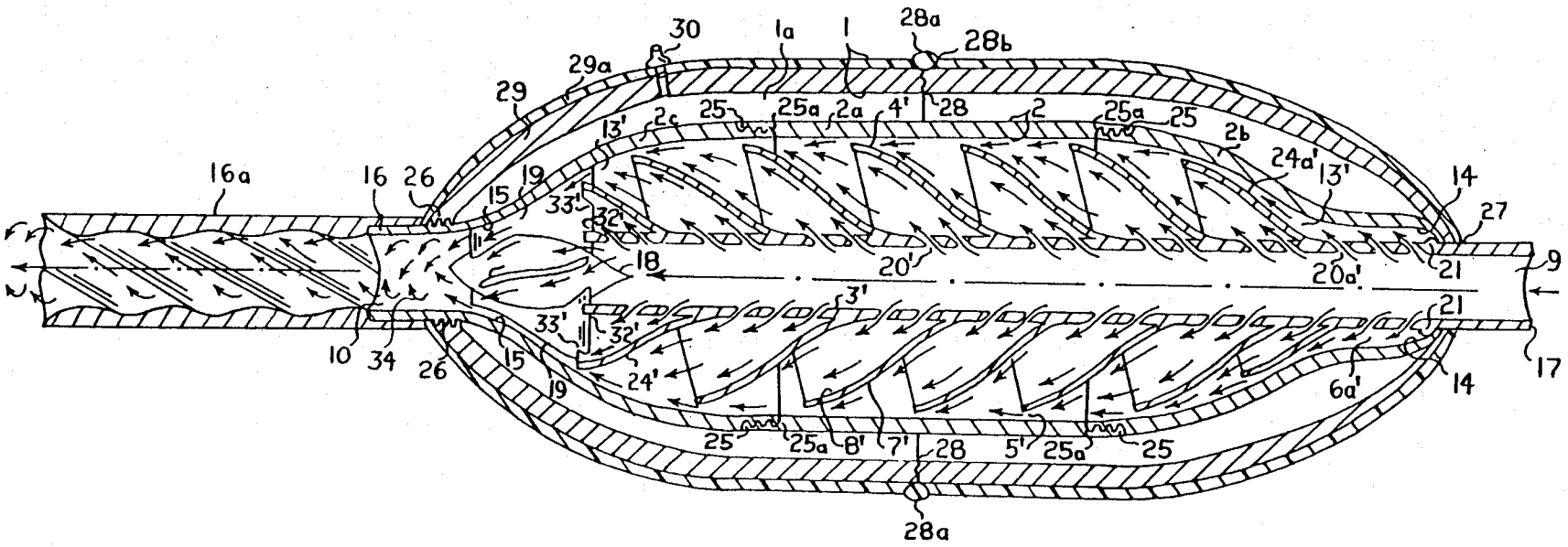
FIG. 6 is a diagrammatic longitudinal cross-sectional view of TYP II similarly depicting its method of internal assembly as differentiated from that of TYP I, including the gas-flow vectors as directed against the exhaust-end torpedo and its vanes by reason of this embodiment's internal helical design and the flow path of the attached conduction tunnel extension. Both embodiments, however, are constructed in accordance with and incorporate the features and principles as described herein.
Figure 7:
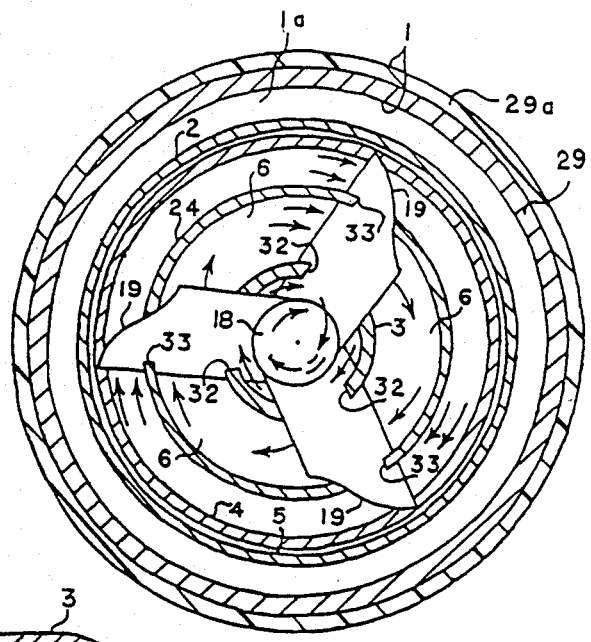
FIG. 7 is a diagrammatical vertical cross-section elevational view of the silencer detail common to both TYP I and II at their exhaust ends, taken as indicated by the line A-B as shown in FIG. 5, TYP I. This view is shown by sectioning away the outer protective jacket and inner tubular gas-conduction housing (hereinafter called the inner shell) which allows detailing the exhaust end torpedo and its vanes intersecting the inner pipe and gas-deflection cones, as in TYP I, or intersecting the inner pipe and helix, as in TYP II. This detail is understood to be common in both TYP I and II.

Between the intake-end-facing surfaces 7 and the exhaust-end-facing surfaces 8 of the cones 4 are formed a series of gas-expansion chambers 6 (FIGS. 4 and 6, TYP I). Between the intake-end-facing surface 7' and the exhaust-end-facing surface 8' of the helix 4' (FIGS. 4 and 6, TYP II) is formed a continuously running helical gas expansion chamber 6' circumferencing helically and running axially the entire length of the inner tubular member 3'. In both TYP I and II the expansion chambers 6,6' graduately increase in capacity from their bases at the central tube 3,3' and expand as they approach the Bernoulli-effect apertures 5,5'.

The cavities or expansion chambers 6,6' so formed as above described are contiguous to and communicate with the central tube 3,3' by means of its perforations (or porosities) 20,20' which act as a means to outlet gases into the expansion chambers 6,6' allowing free expansion of gases throughout the entire system from the central channel 3,3' through the expansion chambers 6,6' and thence into the Bernoulli and suction-effect-producing apertures 5,5' in following their natural axial and radially designed direction of travel from the point of entry into the device at the intake end 9.

The restricted apertures 5,5' in both TYP I and II are a means for forcing the gases which enter the expansion chambers 6,6' from the central tube 3,3' to increase in velocity in order to enter and crowd through the narrowing series of openings 5 or continuous opening 5' (TYP II) after having expanded in volume in the chambers 6,6'. The action of the expanded gases at their entry into apertures 5,5' creates at the inner surface of the intermediate housing 2 the characteristic Bernoulli-effect "jetstream" 13,13', which in turn causes the secondary "suction-effect" upon the gases expanding in succeeding expansion chambers 6,6', both of which effects are unique to this device and result from its integrally designed features.

As gases impinging upon the polished and symmetrically curved inner wall of the intermediate housing 2 increase in velocity, they form a continuous "boundary layer" of high-speed gases 13,13' which travel axially from aperture to aperture 5 (in TYP I) or helically and circumferentially through a continuously and axially running helical aperture 5' at the inner surface of the intermediate housing 2 (in TYP II).

The "suction-effect" upon gases reaching the axially and radially outward or centrifugal portion of the expansion chamber(s) 6,6' in both TYP I and II becomes reinforced and increasingly amplified as the total volume of combined masses builds up as gases entering the boundary-layer 13,13' from axially succeeding expansion chambers 6,6' combine with the boundary layer "jetstream" 13,13' itself in its axial travel. Its velocity must successively increase in order for the increasing volume of its gases to pass through succeedingly rearward apertures 5 or succeedingly rearward portions of the helically continuous aperture 5' (TYP II).

In TYP II exhaust gases passing through the helical aperture 5' are additionally deflected into a vortical combined flow direction which continuously increases in velocity and adds to the suction-effect by increased vortical moment, as gases travel not only axially but vortically and circumferentially around and thrugh the system. The reinforcing effect and continuously increasing accelerating effect created upon the combining mass of gases travelling through the device at successively posterior Bernoulli apertures 5 in TYP I, and at successively posterior portions of the helically positioned Bernoulli aperture 5' in TYP II, together with the increased kinetic moment imparted by the vortically spinning motion of the entire gaseous masses combining in TYP II, are uniquely embodied in this apparatus.

The jetstream aperture(s) 5,5', expansion chamber(s) 6,6' and the central sound and gas-conducting channel 3,3' are all acoustically and fluid-pressure coupled so all gases are smoothly drawn into the jetstream 13,13' and so that a maximum of sound is absorbed and dissipated by expansion and being drawn into the laminar flow or boundary layer well before reaching the exhaust end of the unit. Additionally, individualized proportions of surfaces, edges, apertures 5,5' and perforations (or porosities) 20,20' in the central tube 3,3' are computed and engineered to correspond best with individual acoustic and gas-density varying characteristics of the sound frequencies, type and densities of the gases propagated by combustion operation of the different types of engines to which the device may be applied.

Accordingly, the right to vary the above specifications to accord with the individual characteristics of each type of engine to be fitted with the device are reserved by the inventors, so long as any variations accord with basic principles as described in this application for letters patent.

Figure 9:
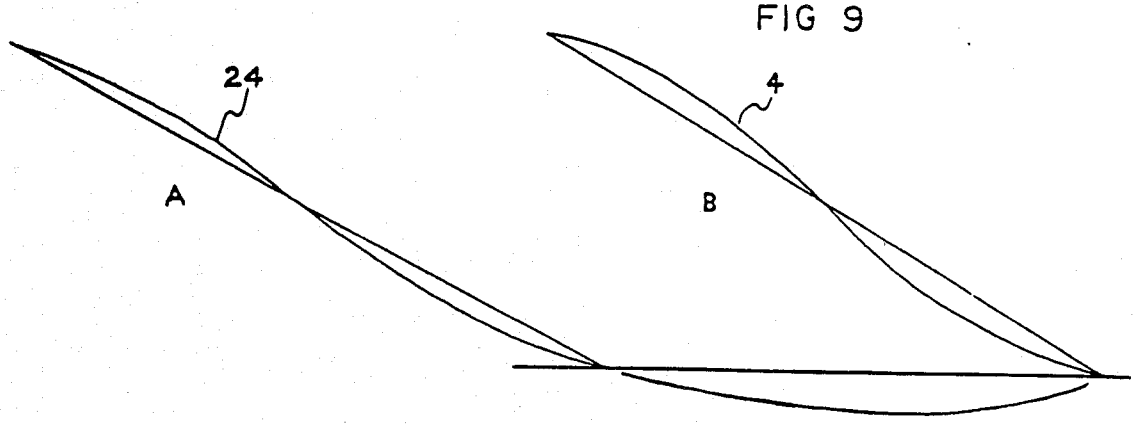
FIG. 9 is a detail of the angle of slope and double parabolic curve common to both conical and helical methods of gas deflection and conduction in TYP I and TYP II. Angle and curve B will be found constant in the main body cones or main body helix portions in both TYP I and II, while angle and curve A will be found constant in both TYP I and II at the intake and exhaust-end cones of TYP I or both end helical sections of TYP II.
Figure 10:
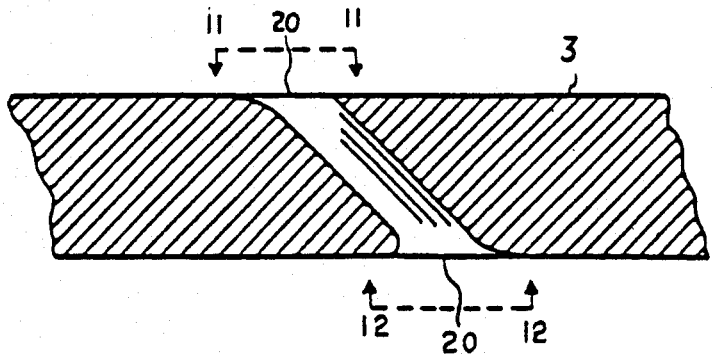
FIG. 10 is an enlarged detail of any one of the hole-type perforations employed in the embodiments depicted herein and common to both TYP I and II, detailing the angle of drilling and methods of edge and shoulder shaping and chamfering, and detailing with line 11—11 and 12—12 the directions for viewing the appearance of any perforation at either the outside or inside surface of the inner tubular member as shown in either embodiment in FIGS. 3, 4, 5 and 6.
Figure 11:
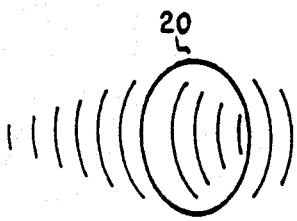
FIG. 11 is an enlarged, outside diameter view of any of the perforations, taken along the line 11—11, as shown in FIG. 10, and showing the nature of drilling the angled and chamfered perforation into the surface of the inner tubular member.
Figure 12:
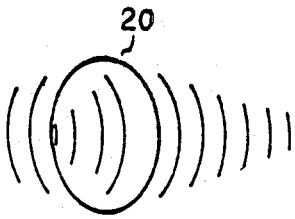
FIG. 12 is an enlarged, inside diameter view of any of the perforations, taken along line 12—12, as shown in FIG. 10, and showing the nature of drilling the angled and chamfered perforation into the surface of the inner tubular member.

FIG. 9 shows that cones 4 or helix 4' sections may vary in their angle of pitch or slope, in that angle B of 30° is found in the cones 4 or helix 4' section enclosed by the main or enlarged central portion **2*a* of the intermediate housing 2 of each of TYP I or II models, and Angle A of 27° is found at either the progressively increasing pitches and diameters of cone 24*a* and helix sections 24*a'* housed by the intake end 9 of the intermediate shell 2 in TYP I and II or the progressively decreasing pitches and diameters of cone 24 and helix 24' sections housed by the exhaust end 10 of the intermediate shell 2 in both TYP I and II. In TYP I the cones 4 are separate although partially nested, while in TYP II the conical helix 4' winds continuously around the axial length of the inner tubular member 3'**.

The cones **24*a*, 24 or helix 24*a'*, 24' sections at both intake 9 and exhaust 10 ends are altered in diameter and pitch as a means to smoothly either initiate at the intake end 9 or continue at the exhaust end 10 the laminar flow characteristics of all gases directed toward the parabolically sloping entrance 14 and exit 15 walls of the intermediate housing 2** in both TYP I and II.

Although in the preferred embodiments described above the angles of cones 4 or helix 4' are specific, such angles and proportions will vary and are reserved as particular needs or applications arise. Additionally, surfacing of the cones 4 or helix 4' will vary, for example in porosity or uses of ceramic or other coatings and methods of polishing which the inventors are presently researching, and rights to so vary them are reserved within the principles embodied in the device.

The inner tubular member 3,3' which serves as a main sound and exhaust gas-conducting channel comprises a centrally positioned open or unobstructed longitudinally extending or straight-through gas-permeable perforate (or porous) tubular channel of uniform diameter throughout most of its length and of circular cross-section.

At its inlet end, the central tube 3,3' extends longitudinally through an opening 14 in the intermediate housing 2 and through a similar gas-sealing opening 27 in the protective outer jacket 1 to form an intake-end connection bushing 17 or intake channel, such as might connect with an engine manifold or other means of direct engine outlet, in other types of engines.

The periphery of the central tube 3,3' at its inlet end just inside the intermediate housing 2 inner wall at its intake end 14 is enlarged, forming a gas-tight coupling or shoulder 21 which serves as a compression bushing joining the central tube 3,3' to the intermediate shell 2 and outer jacket 1 and which serves to center the inner tubular member 3,3' in the device.

At the outlet end of the central tube 3,3' it is centered and affixed by means of notches or slots 32 cut on a bias into its circumference and matching the helical slant of three torpedo vanes or fins 19 which insert into each slot on an angle perpendicular to and extending radially from a final gas-deflecting torpedo 18 which is affixed, in turn, to the intermediate shell 2 by compression against the outer fitted edges of its torpedo vanes 19.

By means of the above-described assembly, the central tube 3,3' is held fast at the exhaust end 10 of the device, yet this assembly provides a means for easy replacement or repair of any or all parts internally significant to the operation of the apparatus, or for easy installation within the same intermediate shell 2 and outer shell 1 assembly complex of any other later improved internal developments, so long as they fall within the scope of primary design of this invention and of the principles upon which it was conceived, as herein explained.

In this way the updating of components and their installation within the device as they are developed becomes a feasibe reality, and the device becomes as the inventors intended it to be, perhaps the first invention for engine applications that literally "grows" better and gets "newer" as it is used. With this device, planned obsolescence becomes a thing of the past, eliminating at least one bane of engine silencer users.

The inner tubular member 3,3' has two variations according to models of TYP I and II. In TYP II, the central tube 3' comprises a single perforate (or porous) tube to which, on its outer surface is affixed a single continuously wound helical double parabolic deflector 4' previously described. In TYP I, the central tube 3 comprises a series of asembled sections 22 to which, at each joining (see FIG. 8, detail of joinings (22), is also affixed a double parabolic conical deflector 4, the total of which form a nested series previously described. In both TYP I and II, the helix 4' or cone series 4 is longitudinally placed on the inner tubular member 3,3', both types of deflector 4,4' slant or are angled rearward or toward the outlet end 10 of the device, and both types of which serve to conduct expanding gases toward the inner surface of the intermediate cylindrical sleeve or housing 2 and thence into the jetstream apertures 5,5' for acceleration-effect.

In TYP I, each perforated (or porous) section 22 couples with a cone 4 to form modular units which may vary in length for assembly together to fit individual engine needs or the requirements of various types of engines.

In both TYP I and II, the central rubber tubular member 3,3', whether integral or modular, has a plurality of radially disposed and angularly drilled gas-passages **20,20*a*, 20', 20*a*' to insure that a sufficient supply of gases shall escape into the expansion chamber(s) 6,6'. In both TYP I and II, some rows of perforations 20*a*,20*a*' are placed at the intake end 9 of the tubular member 3,3' just within the inner frontal wall 14 of the intermediate housing 2 but before the first of either the series of deflector cones 4 or the first graduated surface of the helix 4' (FIGS. 3, 4, 5 and 6, TYP I and II). These initial perforations 20*a*,20*a*' are so placed to insure that enough gases shall escape into an expansion chamber 6*a*,6*a*' formed between the inner wall 14 of the intake end 9 of the intermediate housing 2 and the initiating part of the deflector helix section 24*a*' or the initial cone 24*a* to serve as a means for initiating the Bernoulli and suction-effect gas-flow characteristic unique to this device as the gases pass through the first Bernoulli aperture 5 or first section of the helical Bernoulli aperture 5' (FIGS. 3, 4, 5 and 6**, TYP I and TYP II).

In TYP I, each assembly or chambered section 22 has perforations 20 axially aligned in series of three longitudinally staggered parallel rows, each radially and angularly drilled. Each row has no more than 6 holes axially staggered with respect to their parallel neighbors (FIGS. 3 and 5), TYP I) so as to reduce interferential turbulence which might occur if single streams of longitudinally flowing gases were to coincide.

In TYP II, perforations 20' are disposed in a single series of three longitudinally staggered parallel rows of radially drilled and angled holes arranged helically around the circumference of the tube 3' and running helically and axially from the inlet 9 toward the exhaust end 10 of the central tube 3 (FIGS. 4 and 6, TYP II). Each row is axially staggered in similar fashion to TYP I.

The resultant effect is that of multiple high-speed streams of gases "blending" to into a single uniformly smooth sheet of flowing gas, directed radially and axially outward and rearward by the angle of each perforation 20,20'. This method of gas permeability promotes easy unimpeded escape of expanding gases from the central tube 3,3' while it may retain its integral strength despite a high number of perforations. This is considered by the inventors as a factor in lowering the frequency of any need for replacement, and thus extending the life of this major working component of the unit.

In both TYP I and II the angle of each perforation 20,20' is drilled such that its forward edge is on the side of the central tube 3,3' and its rearward edge is on the inside of the central tube 3 and its rearward edge is on the outside surface, i.e., drilled axially and angularly rearward from the inside to outside surface of the inner pipe 3,3'. Each perforation 20,20' is chamfered at leading and trailing edges and corners so as to present an elliptical appearance at both inner and outer surfaces of the central pipe 3,3' (FIGS. 3, 4, 5 and 6 and FIGS. 10, 11, and 12, detail of perforations). Each perforation is knuckled, or burnished to a rounded edge, at all leading gas-contact edges to eliminate gas turbulence and any possibility of high-frequency edge-created sound (see FIG. 10 detail).

The angle of drilling of each perforation 20,20' shall be 35° radially outward with respect to the longitudinal axis of the inner tubular member. Although in the preferred embodiments depicted herein, but not limited to the methods depicted only, the series of openings are perforations, the inventors reserve the right to employ other methods of gas transfer from inner tubular member to expansion chambers, and are presently considering other developments such as porous materials or other acoustically relevant angles or placements of perforations in applications which lie within the scope and principles of this invention, and as research may dictate are feasible.

In both TYP I and II, the rows of gas-passages 20 or the single series of passages 20' (FIGS. 3, 4, 5 and 6, TYP I and II) are placed just adjacent to the rearward or exhaust-side-facing surfaces 8,8' of the conical deflectors 4 or the continuously running helical deflector 4', to place the passage in communication with the interior of the expansion chamber(s) 6,6' so formed by the deflectors(s) 4,4'. The surrounding open chamber(s) 6,6' then to serve to cool and expand the gases while conducting them toward the Bernoulli apertures 5,5'.

A final gas-deflection torpedo 18 with its attached fins 19 is centered to and held fast at the longitudinal axis of the device and placed just inside the interior wall 15 of the exhaust end 10 of the intermediate housing 2 final assembly section 2*c*. The fins 19 attached to the torpedo 18 on its outer circumference are placed equidistantly trisecting its surface and attached helically thereto, extending radially outward from the surface of the torpedo 18 until their radially outermost edges butt against the compoundly curved interior wall 15 of the intermediate housing 2, to which they are shaped to match. FIGS. 3, 4, 5 and 6, TYP I and II.

At the forward or intake-facing edges of the torpedo fins 19, they are fitted into biased notches of slots 32 cut into the exhaust end of the central tubular member 3,3'. Radially outward, the fins 19 are fitted into similar bias-cut notches 33 in the rearwardmost edges of either the final cone 24 in TYP I FIGS. 3 and 5, or in the final section of the helix 24' in TYP II, FIGS. 4 and 6.

By means of the notches above described at the forward or intake facing edges of the torpedo fins 19 and the fitted contour at the radially outward edges of the fins 19, the torpedo 18 and fin assembly 19 is held fast and centered in the gas stream which flows through the central tube 3,3' and the fins 19 serve to impart a helical vortex motion to the entire gas flow through the device, whether it is that flowing in the central channel 3,3', the final expansion chamber 6,6' or the jetstream 13,13', at their point of final combination, before exiting the device.

The torpedo and fins 18 and 19 are designed aerodynamically and rounded at leading and trailing edges, so as to impart a final high speed vortical rotation to the entire mass of gases flowing through the device and to eliminate air-rush sounds characteristic to gases colliding at differing speeds, such as gases exiting from an exhaust system into a relatively slower-moving surrounding atmosphere.

As all final streams of exhausting gases flow into and through the three main channels of gas conduction: that is in the inner central conduit 3,3' in the final expansion chamber 6,6' and the final part of the high-speed boundary-layer jetstream 13, 13', they combine to flow across and around the torpedo-fin complex 18 and 19, thus forming a powerfully vortical single flow which spins therefore completely silently into the atmosphere, a final tailpipe assembly, or other conduit means 16*a* (FIGS. 3, 4, 5, 6, 13, 14, 15), depending upon the type of engine or application to which the system may be applied. The final torque-imparting torpedo and fin complex 18 and 19 is universal in both TYP I and II, and is unique to this invention. It may be omitted where alternate means FIG. 13 of vortex induction is applied, however, such as necessary for projectile weapon silencing, and the central tube 3*a*, 3*a'* may be extended and affixed by 15*a* to the exhaust end wall 15 of the housing.

Figure 13:
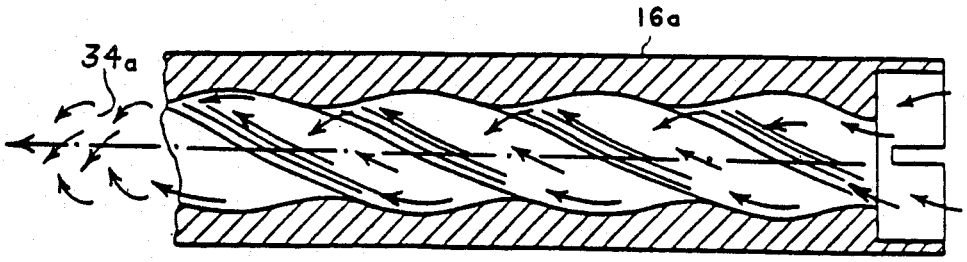
FIG. 13 is an enlarged longitudinal, cross-sectional view of the method of attachment and the helically running surface annulations in the helically-rifled final exhausting gas conduction channel, which final channel may function as an exhaust pipe and attach to the exhaust end of the entire device, as depicted in FIGS. 1, 3, 4, 5 and 5, for example, as in automotive or other engine types of applications, or may function as a complete and independent silencing device as shown by itself, for example, by producing vortical motion in exploding gases flowing through its rifled channel, or in combination with FIGS. 3, 4, 5 and 6 as shown essentially, but with the torpedo-and-vane assembly removal, may function as a projectile-propelling weapons silencer, for small or even for large caliber weaponry and ordance.
Figure 14:
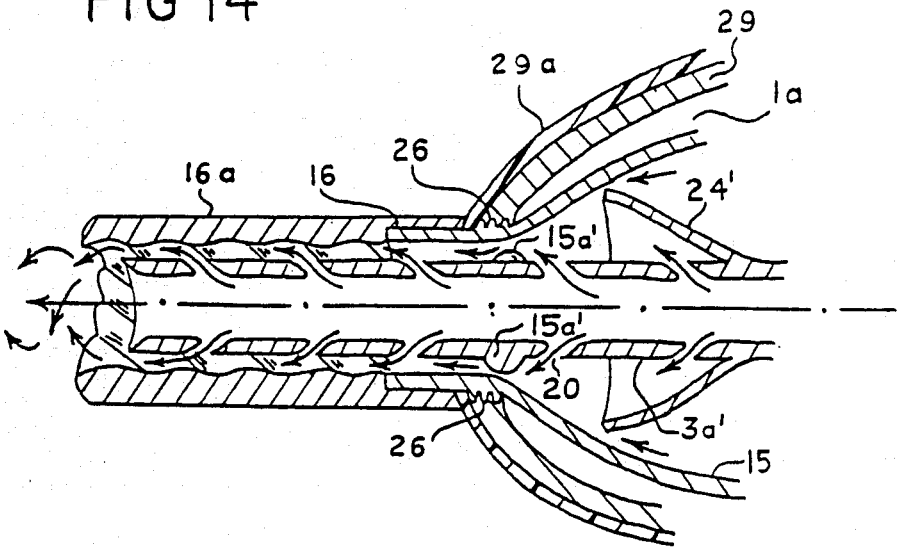
FIG. 14 shows in partial section a variation of FIG. 13, affixed to the device of FIG. 1, but with the torpedo and vanes removed and having a fully extended main channel, showing a suggested method of butting the extended main channel to the internal wall of the intermediate housing similar to that employed at the intake end in FIGS. 3, 4, 5 and 6, but not limited to that method shown, and as applicable to projectile-propelling explosive weaponry.
Figure 15:
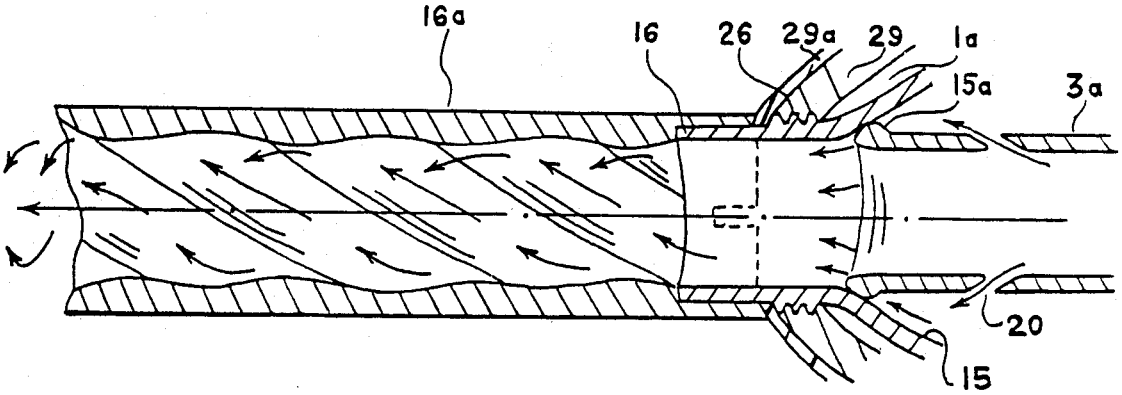
FIG. 15 is a sectional view of an alternately shortened version of an extended main channel silencer, or device for fluid control applications, where the torpedo and vanes are unnecessary or inappropriate, the vortical flow being produced solely by the attached rifled channel shown in FIG. 13.

The final exhaust end 10 of the apparatus is formed by the intermediate housing 2 extending longitudinally through the outer protective jacket 1 (see detail, FIGS. 3, 4, 5 and 6), and serves a dual purpose of forming a gas-conduction tunnel 16 for the final vortically spinning combined mass of gases 34 to exit through, and at its outer circumference, forming a bushing 16 for connection, if desired to standard exhaust handling means such as a tailpipe in auto or truck uses, or to a rifled extension conduit (FIG. 13). In other applications, the tunnel 16 may serve alone as silent means for gases exiting the device to re-enter the atmosphere directly.

An optional vortex-ending conduit 16*a*, FIG. 13 (cross-section) with inner rifled surface annulations may be added at the bushing 16 (FIGS. 3, 4, 5, and 6) to avoid breakdown or dissolution of the vortex 34 otherwise possible if ordinary exhaust pipe with its surface variations is used, worsening after corrosion occurs. As shown attached herein (FIGS. 3, 4, 5 and 6), the conduit FIG. 13 adapts by standard means or butted to the bushing 16, provides a flush surface to prevent enturbulation. Appropriately connected to any source of explosion, the conduit FIG. 13 produces vortical motion by itself, silencing exploding gases in any degree and functions alone as superior silencing means. With torpedo-and-naves arrangement removed, and, by extending the central channel 3,3', with an added gas-permeable tube 3*a* at its center, it is a superior projectile weapons silencer with any range weapon, and may function with an extendedly formed central tube 3*a*,3*a'* in conjunction FIGS. 14 and 15 with the device of FIG. 1, but with the torpedo and vanes omitted, or as shown in FIG. 13, alone.

SPECIFICATIONS AND DESCRIPTIONS OF MANUFACTURING PROCESS

The following is a discussion of features of our invention with particular regards to methods and specific details of manufacture or processes of manufacture which are integral to proper functioning of the principles inherent in the design of the unit. Reference is made to the drawings accomanying this application for letters patent by citing FIGS. 1 to 15.

In keeping with our previous discussion on principles of fluid flow and boundary layer mechanics, as well as dynamics of turbulence, viscosity and fluid friction effects, the inventors have considered certain details of manufacture to be critical factors in promoting the desired results intended by our apparatus: elimination of exhaust noise, pollution from unconsumed fuels and back pressure upon the engine to which the device is applied.

High frequencies can be generated by rapid flow of gases past a sharp edge or roughnesses in a surface with which they may come into contact, such as may exist in an exhaust train, or venturi noise in a carburetor, or friction between a forceful exhaust flow and the surfaces of exhaust conduit channels. Generally, high frequencies show up as a whistling noise, which varies in decibel levels or pitch with the speed or volume of the gases flowing past the edge or surface.

Figure 3:
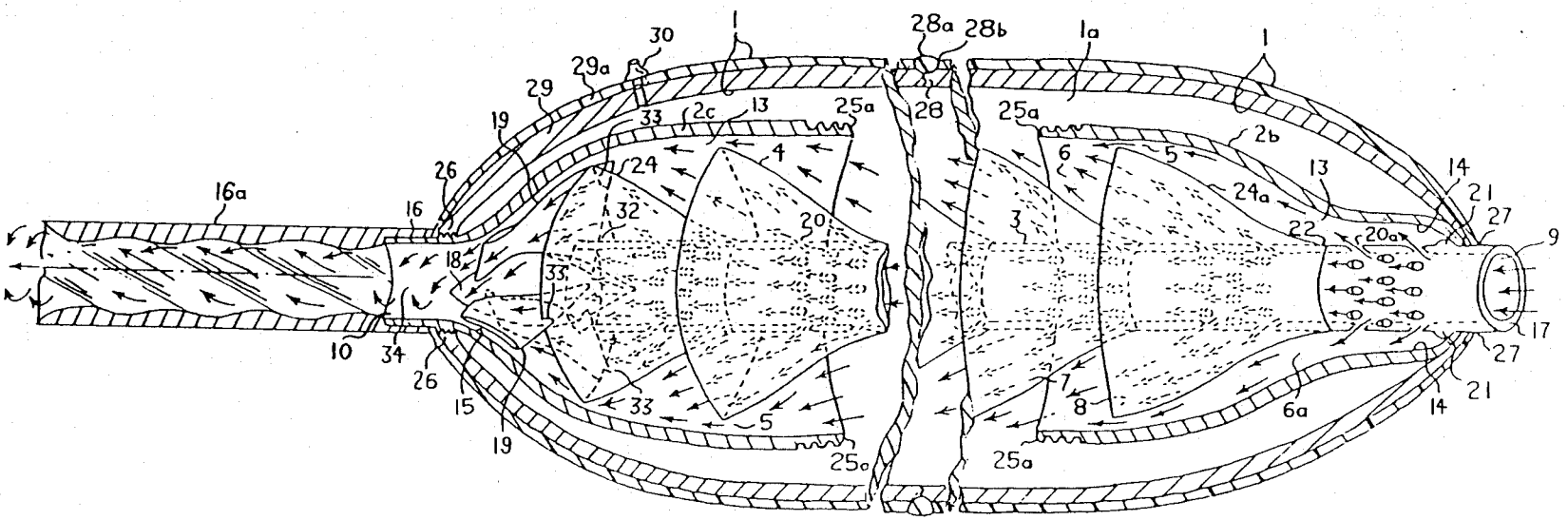
FIG. 3, TYP I is a schematic illustration in partial section and partial transparency showing the internal construction details of one of the preferred embodiments of the invention, here entitled TYP I, depicting the paths taken by exhausting gases as they are conducted through the device and illustrating the suction-effect and Bernoulli-effect flow paths which are unique and novel to this invention with its attached vortexing conduction tunnel extension.
Figure 5:
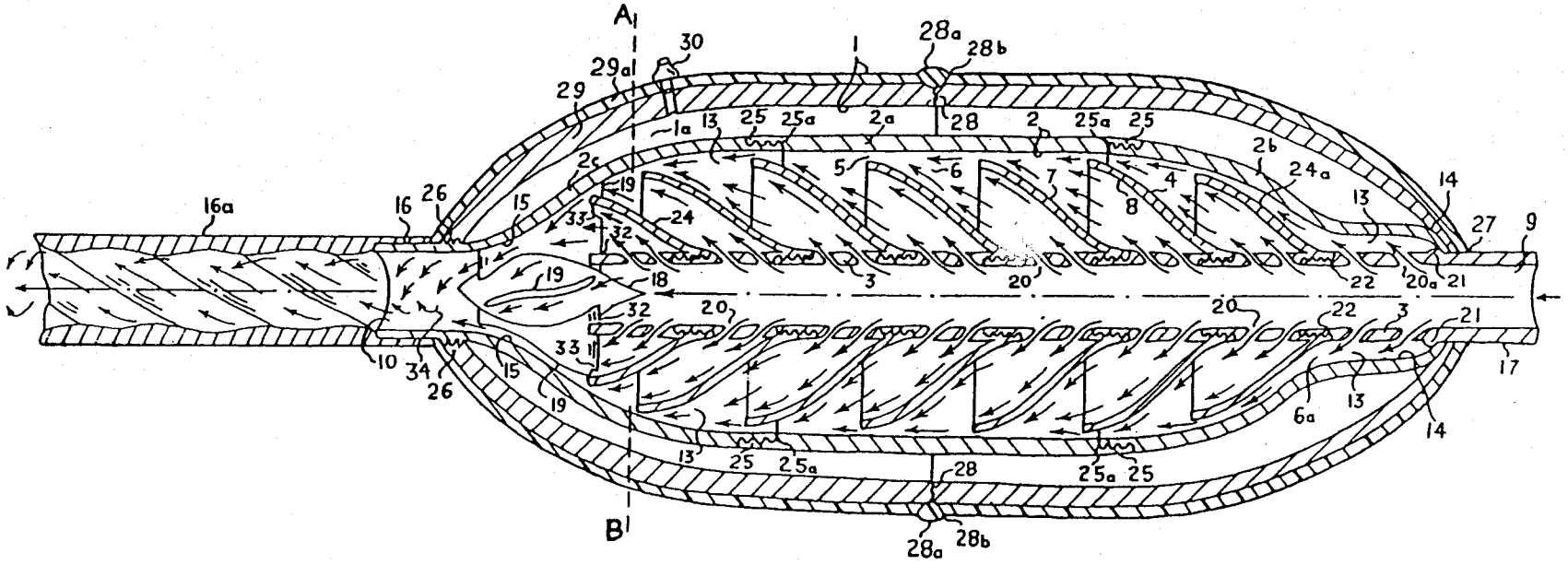
FIG. 5 is a diagrammatic longitudinal cross-sectional view of TYP I taken along the axis of gaseous travel, depicting the details of its unique sectional inner assembly and showing partially in section the exhaust-end torpedo and vanes and its gas-flow paths and the flow path of the attached conduction tunnel extension.

Accordingly, the entire central exhaust conducting channel 3,3', FIGS. 3, 4, 5 and, acts as a high frequency tuning chamber as a result of its many perforations 20,20′ or porosities, and each perforation 20,20′ in the central tube 3,3′ acts as a small tuning tube. For this reason, all perforations are angled to align aerodynamically with the optimum direction of gas flow and their leading and trailing edges are smoothed and polished as well as aerodynamically shaped to conform with optimum frictionless gas-flow efficiency principles, FIG. 10, detail of perforations, TYP I and II.

Further, in accordance with the same acoustic concerns listed above, care must be exercised as well that there are no kinks, flattened areas, raised projections or protuberances to obstruct the smooth flow of exhaust gases in the silencer. Any obstruction caused by unintentionally restricted passageways, or internal blockage of the smoothest laminar flow of gases resulting from roughnesses in conduction surfaces will cause turbulences which themselves will impede the freest gas flow and reduce power and fuel economy in any engine, as well as obstruct and reduce the intended optimum cooling and silencing effects of the device.

Therefore, all gas-contacting internal surfaces are well buffed and polished to micro specifications of smoothness and shaped aerodynamically to conform with the general design as computed to produce the least turbulence-layer effects. As well, the inventors are researching application of ceramic or other smooth types of coatings to the internal surfaces with the purpose in mind to eliminate as far as possible surface-friction or fluid drag effects, and these modifications are considered by the inventors to be covered in this application, to be reflected in the claims section as being in keeping with the spirit and principles embodied in the preferred embodiments specified herein, and specifically to lie within the scope of this invention.

In the two preferred embodiments presented herein, TYP I and II, FIGS. 3, 4, 5 and 6, perforations 20,20′ in the central pipe 3,3′ are drilled at an angle of thirty-five (35°) degrees from the horizontal axis of the device, and when drilled through present an elliptical appearance on their inner and outer surfaces, when viewed from a point perpendicular to either surface. See FIG. 10, detail of perforations, and FIGS. 11 and 12. The inside and outside edges of each perforation 20,20′ shall be chamfered round and smooth, so that the impact of gases under pressure is minimized at the leading edges in the inside surface of the central pipe 3,3′, and the coefficient-of-drag or burble-effect potential of gases streaming from the trailing edges in the outside surface of the central tube 3 is likewise reduced to as near optimum as possible. Because of our attention to the above detail in the design of our apparatus, the flow of gases from the perforations 20,20′ to the walls of the conical deflectors 4 or helical deflector 4′ is made turbulence-free regardless of the volume, velocity, viscosity or density of the exhaust gases.

A secondary method of achieving turbulence-free gas flow from the central channel 3,3′ to the expansion chambers 6,6′ presently being researched and implemented by the inventors is that of creating porosity in the central channel 3,3′ by means of electron beam drilling processing of the surfaces in that central conduit. This method also, though not embodied in either TYP I or II, is considered to be within the scope and principles as enumerated within this application, and is reserved for application as a modification by the inventors to this invention, in keeping with the general and specific principles as embodied herein. Other methods of creating porosity are likewise reserved, as applied specifically to this invention.

Figure 8:
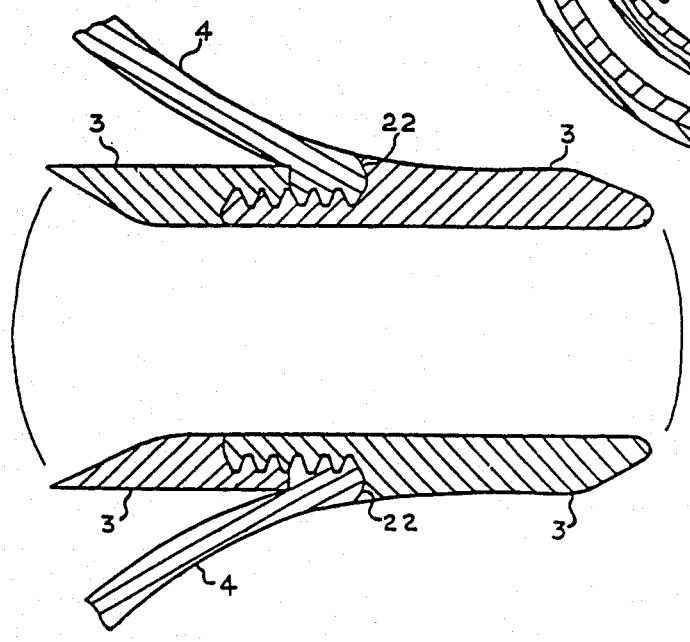
FIG. 8 is an enlarged detail of one of the joinings in TYP I, as encircled and shown in numeral 22 of FIG. 5, TYP I, depicting the method of sectional construction and joining of the several inner elements which give this embodiment its unique advantages.

In keeping further with the critica theme of turbulence elimination, methods of attachment of the conical deflectors 4 or helical deflector 4′ must be consistent with the rest of the apparatus. In TYP I, FIG. 8 shows clearly the method of joining of each cone 4 to the intake end of each central tube 3 section, and the method of grooving which, when attached by means of threaded connections 22 to the section ahead, toward the intake end 9, provides a joining at the inside and outside surfaces of the central tube 3 which is flush and virtually turbulence-free. With regard to TYP II, the helical conical deflector 4′ is bound around the central tube 3′ by means of a shallow groove helically cut into the outer surface of the central tube 3′, forming a continuous spiral trench into which the helix 4′ is continuously strip-welded and the weld then polished and ground flush with the outer surface of the central tube 3′. A means of cutting the insertion channel for the helix would be to insert a chuck connected with the rotary shaft of an engine lathe for rotation at constant speed into one end of the inside pipe 3′ so as to support it, the other end of the pipe being supported by an arm for holding it on a fixed axial line. Then a cutting tool is moved along the axial direction of the outside surface of the pipe at a constant speed, in contact with the surface of the pipe, while the pipe is rotated with the axial movement of the cutting edge, so as to make the helical groove a sufficient depth to affix the helix thereinto.

In TYP II, perforations 20′ are also drilled in a helical pattern of three parallel rows, FIGS. 4 and 6 running continuously the length of the central channel 3′, their spiral pattern differing from the parallel repeated sets of three rows circumferentially drilled in TYP I, FIGS. 3 and 5.

Both the interior of the smaller portions 2*b*, 2*c* in intermediate housing 2 at its inlet and outlet ends 9 and 10, and the exterior of the larger-portioned cylindrical central section 2*a* are threaded 25, 25*a*, so they also may be joined smoothly to eliminate any internal surface turbulence potential.

An additional critical factor to consider in eliminating turbulence is the potential for back-pressure turbulence which may be induced by the impact of high velocity flowing gases upon the vortex-producing vanes 19 of the final torpedo 18, in both embodiments. In the Kasper device compared herein, the impact of an outer flowing stream of gases upon its vanes is considerable, since they are not aerodynamically designed but merely angled with reference to the otherwise straight axial flow of gases within that device. Such impact is called bluff-body turbulence, and at least in the science of aerodynamics, is a source of great consternation to aviation designers and others concerned with minimal turbulence production.

In the Kasper device, bluff-body effect is only somewhat compensated for the vortexing of exhaust gases (partial vortexing, that is, since not all of the gases flowing through that device are deflected by the vanes therein) and by the partial vacuum claimed to be created by that device. However, since a great deal of drag-coefficient and turbulence at the downstream surface of trailing surface of those vanes must be produced by impact of the straight-through flow at a considerable angle upon the vanes, and since the vanes are not noted either to be polished on their surfaces or otherwise aerodynamically designed than stated to be 'curved'

(sic), anyone familiar with the art and science of aerodynamics would note that the effect of an incompressible fluid (or gases, not subject to compression at the moment) flowing past a 'curved' surface would, according to the laws of airflow dynamics, produce what is called an "airfoil" effect around the 'curved' surface. This always produces some turbulence at trailing edges of the curved obstacle intersecting the airflow.

Further, it is well-known that the greater the angle of intersection of a bluff-body with a horizontal airstream, the greater the impact and turbulence potential. Also, surface friction against such a surface or vane would increase with the increase in angle, although retaining some axial original momentum, so long as the the angle of intersection was less than (90°) degrees, which at that angle would be a direct barrier. Therefore, in Kasper's device, turbulence and impact-induced back-pressure, though somewhat angular and thus mitigated, renders the back-pressure reducing effect of the vortexing of gases in an exhaust system far less efficient than it might have been if originally designed with these aerodynamic basic principles in mind. Also, where surface friction against the vanes increases when no attention has been given to surface treatment and load conditions on the device increase or higher speeds in engine operation are reached, turbulence from that source increases back-pressure as well.

In the present embodiments of our invention, all surfaces and curves are designed aerodynamically and treated so as to enhance the natural flow tendencies of expanding gases, and are evenly and curvilinearly shaped as described above in the specifications to conform to natural flow directional patterns. This is specifically done to approach zero coefficient-of-drag as closely as possible. The double parabolic curves of all deflector surfaces 24,24',4,4' both in TYP I and II embodiments, FIGS. 3, 4, 5 and 6 not only relieve both the angular-momentum type of impact pressures by gradual induction of axial or angular changes in vectors of flow but also prevent an airfoiling effect at the ejection point of the flowing gases at the cone 4 or helix 4' trailing edges because that point is the intersection point of the outer jetstream 13,13' with the gases flowing radially against the exhaust-facing surfaces 8,8' of the cones 4 or helix 4', where the Bernoulli and suction-effects of the device are strongest, counteracting any possibility of a trailing edge burble-effect or turbulance. The compound curves in our device create a smoothly changing flow without turbulence at any point of contact with either forward 7,7' or rearly facing 8,8' deflector surfaces, since parabolic surfaces have a focusing effect upon induced flows.

Finally, polished surfaces throughout, and the angle of attack of the final torpedo and vane arrangement, 18 and 19, FIGS. 3, 4, 5 and 6, on all gases exiting the device, insure the utmost reduction of surface-drag or impact turbulence created by fluid friction. The polished final torpedo 18 is designed so that angle of twist or vortical gas flow is induced gradually by varying both the angle and curves of the surfaces of both the torpedo 18 and vanes 19 to cause a gradually increasing angle of attack of the gases. In this way, impact is minimized to the utmost.

In the helical TYP II, the same principles are employed in that the curves of the two parabolae in the deflecting helix 4' are unequal (the convex being sharper than the initiating concavity), thus applying the above principle to the whole process of gas flow from its initial entry into the device until its exit to the atmosphere.

Therefore, in TYP I as well as TYP II, naturally expanding and cooling gases are permitted to follow natural laws of aerodynamics and fluid/gas dynamics of flow, and, by deflection as described above, are simply induced to do what they would naturally do anyway, only much more efficiently and unrestrictedly, and are even helped to do it by the action of the jetstream or suction-effect of the contiguous high-speed outer jetstream flow 13,13'. Since hot gases have a tendency to expand and thus cool, and to entropically reduce of release their kinetic energy as molecular or gross motion proceeds, assisting this process can only be beneficial to any device which purports to eliminate noise and produce the other effects sought as before enumerated. As natural molecular impact occurs with contiguous molecules of a homogeneous substance, and such molecules are relatively cooler to begin with, as in jetstream 13,13', the effect is dispersed to the whole mass. In a vacuum or partial vacuum environment, any gases flowing into it will tend to molecularly disperse, thus losing momentum in this way, or entropizing, since molecular motion proceeds at much reduced rates in vacuo, or partial vacuum states, it produces less molecular interference, and thus less turbulence.

The methods of manufacturing details enumerated herein are designed to promote that process to its optimum.

SPECIFICATION AND DESCRIPTION OF THE PROCESS

In our device, the application of the principles of fluid flow physics as above-described, together with the construction and details of manufacturing processes and methods as before-described, result in a process or method of treating a flowing substance, exemplified herein by exhaust gases produced by the combustion of fuels in any type of fuel-burning engine, to accelerate flow and tangentially produce vortical motion upon the fluid, or, in this example, so as to assist the expansion and cooling of such gases in a manner which will eliminate noise from their entry into surrounding atmosphere while creating a negative back-pressure or suction scavenging effect upon the engine to which the device is applied. Specific description of the process is made by reference to FIGS. 1 to 15, as follows:

In operation, the apparatus, FIG. 1, allows exhaust gases flowing from any combustion engine to flow through an unobstructed inlet bushing 17, FIGS. 3, 4, 5 and 6 to enter the device FIG. 1 into a central perforated or porous gas-conduction and primary expansion channel 3,3', FIGS. 3, 4, 5 and 6, TYP I and II, wherein, in both embodiments, the gases then expand longitudinally and radially to enter in part through the first set of either succeeding perforations 20*a*, TYP I, FIGS. 3 and 5 at the inlet end 9 of the central conduit 3 and remaining gases continue longitudinally until the next axially rearward set of perforations 20, wherein the process is repeated, or in TYP II, FIGS. 4 and 6, gases first enter through 20*a'* and then continue to succeeding helically placed perforations 20'.

Gases entering into a first expansion chamber 6*a*, 6*a'* at the unit intake end 9 just rearward of the intermediate housing 2 inner wall 14 and before the first conical deflector 24*a* or helical section 24*a'* expand with attendant cooling effect and are conducted by the shaping of the interior walls 14 of the intermediate housing 2 to impinge upon the first of the conical deflectors 24*a* or first helical section 24*a'*, in both embodiments.

The gases expanding into the chamber 6*a*, 6*a'* are thus directed radially outward from the axis toward the first Bernoulli-type aperture 5', TYP I, FIGS. 3 and 5, or the first section of a continuous helically and axially running Bernoulli-type aperture 5', TYP II, FIGS. 4 and 6. Such apertures are produced by the close approach of the cone or helix section 4,4' in both embodiments to the inside surface of the intermediate housing 2, which creates a narrowing passage 5,5' against the intermediate housing 2 and causes the expanding gases to increase the velocity as they form into a boundary layer stream 13,13' against the inner wall 14 of the intermediate housing 2.

More specifically, such interaction is designed to converge exhaust gases from the several radially inner and distinct masses entering the main channel 3,3' and thence into the expansion chambers 6 in TYP I or continuous helical expansion chamber 6' in TYP II into one radially outer more rapidly moving mass 13,13' travelling longitudinally against the intermediate housing 2 inner wall 14. The effect of this convergence is to create a partial vacuum effect upon the gases issuing from the main conducting channel 3,3', and upon those expanding in the expansion chamber or chambers 6,6'.

The same interaction also creates a marked difference in velocities between the outer "jetstream" flowing mass of gases 13,13' and the inner main and surrounding channel gases.

The differential in velocities so created drastically lowers gas pressures in the main and surrounding channels 3,3' and 6,6' in both embodiments, as gases within those channels are swept into the higher velocity "jetstream" 13,13'. In effect a marked "suction" effect is produced, acting upon the centrally expanding and cooling gases, increasing the effectiveness and efficiency of that expansion and cooling process many fold.

As the radially outward-moving streams of warmer gases blend into the cooler "jetstream" 13,13' and move in an increasingly combining mass longitudinally rearward toward the exit end 10 of the device FIG. 1, this increased volume of gases must travel over succeedingly rearward expansion chambers 6 or a continuously extending helically rearward chamber 6'. Velocity continues to increase, initiating and continuing throughout the axial length of the device from the first expansion chamber section 6*a*, 6*a'* to the exit end 10 a blending of the several gases and the characteristic Bernoulli and suction-effects for which the invention is named, and the resultant effect of negative back pressure unique to this apparatus.

As the combined mass of gases 13,13' is forced by the succeeding cones or helix sections 4,4' to pass at ever-higher speeds and ever-increasing masses through succeeding Bernoulli passages 5, TYP I or a continuously extending helical Bernoulli passage 5', TYP II, and jetted out rearwardly from each cone or helix section 4,4', exhaust gases passing through the central tube 3,3' are absorbed ever more strongly through the perforations 20,20' and expansion chambers 6,6', to augment the combined mass 13,13' as action of the gases within the device FIG. 1 proceeds axially toward the outlet end 10. Efficiency of the process increases as it proceeds.

The entire production of exhaust gases is thus divided by the invention into three major streams of gases. The first stream is that within the main channel 3,3', the second is that expanding from the main channel 3,3' through the apertures 20,20' and into the expansion chambers 6, 6' and decelerating as well as cooling as they expand within the chambers, while the third stream is the high-velocity boundary layer 13,13' or "jetstream" produced by the need for combined gases to pass through narrowing apertures, invoking Bernoulli's laws. In addition, the third stream is initiated and thence continuously replenished and augmented by the second, adding to the total volume of gases travelling through the Bernoulli apertures 5,5'.

In TYP II, with the helix application, a rotating vortical motion is imparted to the combined gases in the "jetstream" 13', adding and increasing an axial and helically combined momentum to that imparted only axially, as in TYP I, see FIGS. 4 and 6. This effect adds strongly to the absorptive action building upon the gases leaving the engine and issuing from the central tube 3' and creates still further negative back-pressure, or a partial vacuum effect, upon the engine to which the device is attached, performing optimum scavenging of all gases directly at the engine and thence throughout the system.

Such helically induced added kinetic momentum powerfully increases both the Bernoulli and suction-effects before noted, imparting a vortical effect powerfully to the entire mass of gases travelling through the device well before they reach the exit end 10, as differentiated from the action of TYP 1, which is axial only, until it reaches the exit end 10, see FIGS. 3 and 5.

As both the inner and outer flows are joined and expressed through narrow apertures 5,5', in both models, the ultimately cooled and relatively silenced gases are directed at the outlet end 10 against the helically placed vanes 19 of a final gas-conducting "torpedo" 18, in both embodiments identical.

The action of the torpedo 18 and its vanes 19 creates a torquing effect upon the mixed gases 13,13' and whatever remains in the final section of the main channel 3,3' or the final section of the helix 24' or final cone 24, adding a final high velocity vortexing motion to the entire mass of gases 34 seeking exit from the device. The torpedo 18 and vane 19 combination thus treats all gases before they may exit the apparatus.

Vortexing gases then must continue through the exit tunnel 16 in a final exhaust-end vortex 34 entering either whatever tailpipe, if any, is affixed to the device, rifled conduit 16*a*, or other means of exhaust conduction, or directly into the atmosphere.

The tunnelling effect of the spinning gases so created allows their entry at higher axial speeds than the surrounding atmosphere, and in a helically lateral direction from the motion of whatever vehicle, if any, upon which the device may be applied, without any of the characteristic air "rushing" sound produced normally whenever a straight flowing stream of gases is imposed at marked speed differentials upon a slower surrounding atmosphere, or a still surrounding atmosphere.

Although speeds of exhaust gases passing through consecutive passages 5,5' rearwardly increase and the absorptive or the suction-effect upon the gases flowing from the inner tubular member 3,3' is enhanced by the action of the cones 4 or helix 4', until at the outlet end 10 the speed of the exhaust gases in escaping through the plurality of perforate passages 20,20' in the central tube 3,3' is maximized, gases reaching the exhaust end 10 have had much of the engine-generated sound removed by the process of expansion and cooling accelerated so greatly by the process described above, yet, if permitted to discharge directly into atmosphere, as in the example of an outlet end of a normal tailpipe arrangement or in other types of engine applications as direct exhaust outlets, the sound of air or gaseous "rush" created by the impact of such high speed gases against the slower surrounding atmosphere can create an audible high-frequency sound. This is why high velocity gases entering a relatively still atmosphere are a source of much exhaust noises experienced in these times.

Therefore, in our device, the passage of gases around the final torpedo 18 and vane 19 assembly is designed to impart a vortical high-speed flow to all gases 34 leaving the final gas conducting tunnel, as differentiated from previous attempts cited herein. This treatment insures that exiting gases will all enter vortically, thus virtually silently into the surrounding atmosphere.

Further, in normal tailpipe employment, such as in automobile application, for example, the source of exhaust noise is generally considered to be somewhat beyond the end of the pipe. This is the impact zone or differential in speeds of moving gases.

By designing the internal and end characteristics of our unit as described above, any source of sound is limited to locations within the device and eliminated there. Moreover, the absence of any type of resonating chambers in our device precludes the possibility of any type of sound created by or with the device itself. By eliminating any such potential of created noise within the device we have increased the net elimination of noise for the unit and the entire process.

Exhausting gases are absorbed from the engine in such a way as to improve both the exhausting or scavenging effect and combustion efficiency of an engine, in that the unburned fuels are not mixed with partially burned fuels as occurs where only partial scavenging exists. Were complete scavenging occurs, operating efficiency of an engine is maximized, power output is increases, optimum and complete consumption of fuel occurs, poisonous by-products of incomplete combustion are minimized, and environmental and atmospheric pollution effects from inefficient engine operation are thus eliminated.

As engine speeds accelerate, producing greater volumes of exhaust gases, "jetstream" speeds increase at the apertures 5,5' in both models, thus increasing load conditions, or the variety of operational conditions under which any engine may be operated.

Further, since additional volumes of exhausting gases under load conditions such as acceleration or continued high speed operation of an engine can only serve to increase the velocity of gases at passages 5,5' and thereby the efficiency of the absorption or vacuum-effect upon the main body of gases passing through the perforations 20,20' in the central tube 3,3', high-performance engine operation is also measurably improved; a factor which makes available at last an exhaust gas-treating system which does not lose efficiency as an engine's peak operating speeds are attained.

However, the above is merely a "negative-gain" feature. Our device proceeds further, to positive advantages features, in that the absence of any moving parts or obstructions, coupled with its integral design characteristics, increases the free-flow effect of the entire process, thereby enhancing positively the increased load efficiency effect upon the engine as higher exhaust gas volumes are processed. In short, the harder the engine works, and thus the device also, the better it performs.

Even at lower engine speeds, and thus comparatively low volumes of exhaust gases, the effect is not reduced measurably since there are no obstructions to impede vectors of flow (to cause turbulence) within the device. Further, gases are conducted without obstruction toward the exit end 10 axially rearward, but completely prevented from returning toward the inlet end 9 not only by the rearward angling of the cones 4 or helix 4' but also by the "jetstream" 13,13' powerfully flowing axially rearward through the only interconnecting spaces: the Bernoulli apertures 5,5'.

And, since even at low-speed operation, gases are being produced by the engine in enough quantity and enough velocity initially to produce a much-pronounced suction-effect, output of the engine is not decreased by back-pressure even at low speeds or low-power output or load. In a geared vehicle therefore, for example, engine efficiency is still much improved in uphill operation at a low gear, or at low speeds.

Even when a vehicle is at rest and its engine is idling, exhaust gases are produced at sufficient volume and velocity to produce the complete effects of the device, thus the final vortexing or tunneling effect of gas-entry into the atmosphere would continue, thereby eliminating characteristic idle-rumble experienced with other types of exhaust-treatment methods, and either at rest or in motion, this silencing effect is created without any increase in back-pressure, in fact, negative pressure.

What is claimed is:

1. A method for controlling flow of fluid, said method comprising:

(a) separating and apportioning said fluid into a primary stream, at least one secondary stream and an accelerated jetstream;

(b) the primary stream being centrally positioned, the secondary stream and the jetstream having substantially co-axial and concentric fields of flow with respect to the primary stream and with each other;

(c) the secondary stream being formed by separating successively downstream-flowing peripheral portions of the primary stream, the separating portions diverging from and enveloping said primary stream;

(d) accelerating peripheral portions of the diverging secondary stream to flow faster than the primary stream;

(e) the jetstream being formed by blending successively downstream-flowing said accelerating peripheral portions of the secondary stream, the jetstream annularly surrounding said secondary stream and having continuous, laminar, downstream flow;

(f) the jetstream peripherally and tangentially transiting successively downstream peripheral portions of the secondary stream and so entraining said portions of said secondary stream;

(g) the entraining secondary stream continuously augmenting mass and amplifying velocity of the transiting jetstream, causing the jetstream to flow cumulatively faster than said secondary stream;

(h) recombining downstream the separated primary stream, secondary stream and jetstream, to form a tangentially accelerated, unified stream;

(i) each of the said streams having a non-reversing, substantially axial unitary flow direction, unimpeded, non-turbulent flow and continuously inter-exchanging fluid-pressure in common with the other said streams.

2. A method, according to claim 1, wherein:

(a) the primary stream has an unreduced, substantially straight-through path of axial flow without closure, said path having substantially constant diameter and said flow having a variable velocity;

(b) the secondary stream diverges in a substantially downstream direction by continuously expanding through a substantially conical, transversely sine-wavelike-forming circumferential field of concavo-convexly arcuate flow;

(c) the step of accelerating peripheral portions of the secondary stream includes peripherally restricting and directing the accelerated said portions to annularly discharge into the jetstream in a downstream-flowing axial direction;

(d) the jetstream, in transiting the secondary stream, causes sufficiently reducing inter-exchanging fluid-pressure in the primary and secondary streams to cumulatively reflex upstream, whereby negative fluid pressure in initially flowing fluid results;

(e) the recombining, augmented and amplified jet-stream imparts a cumulatively higher velocity than that of the separated streams to the unified stream.

3. A method, according to claim 2, wherein:

(a) the secondary stream comprises a plurality of secondary streams, positioned in consecutively downstream series.

4. A method, according to claim 2, wherein:

(a) the secondary stream comprises a successively downstream-flowing, continuously helicoidal secondary stream;

(b) the helicoidal secondary stream has helically rotating, substantially axial flow direction and envelops the primary stream within an extendedly helicoidal, substantially conelike, transversely sine-wavelike-forming, helically circumferential field of concavo-convexly arcuate flow;

(c) the helicoidal secondary stream is formed by separating and diverging from successively downstream, continuously helicoidal peripheral portions of the said primary stream;

(d) the step of accelerating peripheral portions of the secondary stream includes continuously blending accelerating peripheral portions of the said helicoidal secondary stream into the jetstream by annularly discharging the said portions in a helicoidal, continuously spiralling, downstream-flowing axial direction;

(e) the jetstream is continuously formed from, augmented with and imparted an accelerated, helically rotating axial flow by the continuously blending accelerating peripheral portions of the helicoidal secondary stream.

5. A method, according to claim 3, further comprising:

(a) tangentially imparting an accelerated, helically spinning, vortically axial thrust to the said unified stream, whereby forming a single vortexing stream;

(b) the vortically axial thrust of the single vortexing stream further reducing fluid-pressure, by augmenting axial flow, in the said primary stream and thereby, reflexively in said initially flowing fluid.

6. A method, according to claim 4, further comprising:

(a) tangentially imparting an accelerated, helically spinning, vortically axial thrust to the said unified stream, whereby forming a single vortexing stream;

(b) the vortically axial thrust of the single vortexing stream further reducing fluid-pressure, by augmenting axial flow, in the said primary stream and thereby, reflexively in said initially flowing fluid.

7. A method, according to claim 5, wherein:

(a) axial flow of the vortexing stream is indefinitely extended by tangentially sustaining the helically spinning, vortically axial thrust in the said vortexing stream.

8. A method, according to claim 6, wherein:

(a) axial flow of the vortexing stream is indefinitely extended by tangentially sustaining the helically spinning, vortically axial thrust in the said vortexing stream.

9. A fluid control device, comprising:

(a) an axially-extending, unobstructed and unimpeded open and straight-through, fluid permeable, centrally, concentrically and co-axially disposed, smoothly and projectionlessly surfaced, substantially tubular main channel for fluid conduction, the said main channel having an unreducing and substantially constant diameter and having a plurality of individually streamlined, fluid-contact-leading-edge-rounded and unitary-flow-direction-angled fluid-permeable opening means for insuring a peripheral portion of fluid travelling within the said channel to non-turbulently escape and expand from the said channel, the said channel and opening means having proportions and diameters modifiable in manufacture to allow individualized application of the said device to fluid substances having varied physical properties, and the said channel having a portion of its axial length imperforate and extending through and from an intake end of the said device, forming an intake bushing for attachment to a source of fluid flow, the said bushing being modifiable in proportion with the said channel and for the same purpose;

(b) a series of fluid conductor/deflector means, each having substantially truncated frusto-conical configuration and being posited successively downstream from one another so that a base of a frustum of one cone fits over an apex of a frustum of a next successively downstream cone, having transverse surfaces of compound reversing parabolic sine-wavelike curvature, being concavo-convex upon an outer transverse surface of one and convexo-concave upon an inner transverse surface, on a line taken from apex to base of any cone, the said conductor/deflector means being attached at their apexes to and diverging from the said main channel at a substantially downstream-angled pitch with respect to a longitudinal axis of the said main channel, whereby fluid escaping from the said main channel is directed against the convex surface of a cone, deflected and conducted to expand toward a radially outer periphery through sine-wavelike circumferentially expanding flow and discharged at the said periphery of each cone in a downstreamly axial direction, and proportions of each geometric spatial unit of the said conductor/deflector means, diameters of the apexes and bases of the said cones and angles of pitch with respect to the axis of the said main channel being variable in manufacture to fit varied applications and various fluid physical properties;

(c) an imperforate, substantially cylindrical housing, enclosing the said main channel and conductor/deflector means, the said housing having an enlarged, elongate, tubular intermediate center section and having end-closure formed from and by two curvilinearly tapered and sections having compoundly curved walls narrowing from a diameter of the said center section through a reversing double-parabolic curvature to form end walls having a truncated substantially bottleneck configuration at each end of the said housing, the said end sections having each an opening centrally posited with respect to a cross-sectional diameter of the said housing and co-axially aligned with one another and with the longitudinal axes of the said main channel and the said housing, an inlet-end opening snugly fitting, affixing and sealing with an outside diameter of the said imperforate intake bushing portion of the said main channel, an an outlet-end section integrally forming a outlet channel from an outlet-end section end wall by extending on tubular portion of the outlet-end said bottleneck configuration, the said tubular portion having an integral surface curvilinearly integral with that of the said housing to insure non-turbulent exit-flow, an external surface of the said outlet-end tubular portion serving as an outlet-end bushing for connection to an indefinitely extending outlet means, such as an exhaust pipe, or the said tubular portion may remain without connections as an outlet conduction channel, and an inner surface of said housing being in sufficiently close approach with peripherally outermost curved surfaces and trailing edges of the said conductor/deflector means to form a series of curvilinearly narrowing restrictive annular openings between the said inner housing outer deflector surfaces and to force a marked acceleration of flow in fluid passing therethrough, and said openings so angled as to cause downstreamly axial directional discharge, whereby forming a closely limiting boundary-layer jetstream-space wherein the said housing defines the outermost course of the said expanding fluid;

(d) the said device having no practical large or small size limitations and proportions remaining variable in manufacture according to fluid substance viscous resistance, shear stress and other characteristics of individual fluid substance dynamics and being variable in proportions with regard to the said restrictive openings, to accommodate varying physical properties of different flowing subdivided solid particles flowing through the said device and for varying types of applications of the said apparatus;

(e) all internal fluid-substance-contacting surfaces, corners, porosities, perforations, edges and fluid conducting or deflecting means are formed, treated, angled and smoothed so as to have no scooping surfaces, forms or edges and no sufficiently blunted, sharp or projecting edges, shoulders, surface roughnesses or planes opposed to, at obstructively oblique angles or so angled as to obtrude into or intersect a unitary path of substantially axially directed, non-turbulent flow at any micro-stage of entire flow-process within the said device which could cause bluff-body effects, leading-edge shock-wavefronts, fluid cavitation, projective and surface-skin fluid-frictions or boundary-layering, and the said treatment being a means to eliminate turbulence and/or acoustical frequencies altering an intended free, smooth and noiseless flow of fluid substances upon encounter with the said surfaces of the said device at operant velocities and pressures of fluid flow, and all angles, proportions, openings and slopes are stream-liningly adjusted in manufacturing to optimum computations for specific applications and specific fluid properties and characteristics.

10. A fluid control device, according to claim 9, said device further comprising:

(a) a needle-nosed, closed, non-tubular, substantially ellipsoid fluid-deflecting torpedo, being posited in exact alignment with the diametric center of the said main channel at its downstream end, whereby any final downstream portion of still axially flowing said fluid in the said channel is redirected and deflected into a reversing double-parabolic sine-wave pattern of flow, conjoining with that being directed by the said conducting means and the said housing at their most extreme downstream portions;

(b) a plurality of compound reversing parabolic sine-wavelike curvilinear vanes, edge-rounded, attached at their radially inner edges circumferentially to the said torpedo at an angle sufficient to impart helical rotation to any said fluid impinging upon said vanes from generally axial flow directions, while avoiding any turbulent bluff-body effects, the said vanes radially extending to the said housing at its downstream end, all outermost edges of said vanes conforming to interior curvature of the said housing, and being affixed thereto as a means to support and center the said torpedo, whereby said vanes impart helical motion to all combined said fluid flowing through the said device at its downstream end;

(c) a plurality of slots cut into downstream edges of each final downstream portion of the said deflecting means and cut into a final downstream edge of the said main channel, said slots each aligned and cut on a bias conforming with angles and positions of the said vanes, said slots serving as means to attach with and position leading edges of said vanes, whereby the torpedo and vanes are enabled to redirect into and impart a combined helically and axially flowing vortical motion to a totality of any fluid flowing into downstream and portions of the said device and conjoining an impingement points of the said vanes, the said slots being without seams to cause turbulence.

11. A fluid control device, according to claim 9, said device further including:

(a) a substantially tubular, imperforate, longitudinally extending, vortex-extension circuit, having a substantially annular series of edgeless, deeply grooved and seamless, endlessly helical inner surface rifling said conduit being posited at and affixed to a final downstream end of the said device and serving as a means to tangentially vortex, reinforce without dissipation and extend by conduction the vortical motion of the entire flow of all fluid exiting the said device, without vibration or turbulence.

12. A fluid control device, according to claim 10, said device further including:

(a) a substantially tubular, imperforate, longitudinally extending, vortex-extension conduit, having a substantially annular series of edgeless, deeply grooved and seamless, endlessly helical inner surface rifling said conduit being positioned at and affixed to a final downstream end of the said device and serving as a means to tangentially vortex, reinforce without dissipation and extend by conduction the vortical motion of the entire flow of all fluid exiting the said device, without vibration or turbulence.

13. A fluid control device, according to claim 9, in which a means for conducting fluid comprises:

(a) a single, continuously formed fluid conducting surface having substantially compound parabolic curvature of its transverse surface, posited so as to helically run the axial length of the said channel, the said conducting surface being affixed at its innermost edge to the said channel and unfixed at its outermost curves and edge, which said edge closely approaches the said housing at an angle to discharge downstream, whereby any said fluid escaping from the said channel is directed against an outer convex surface of a helical cone, diverged into helically expanding motion and conducted thusly toward the said housing and so discharged;

(b) the said outermost curve and edge of the said fluid conducting surface having curvilinear form so as to closely approach the said housing forming a continuous, helically running, substantially annular, narrowing aperture between the said edge and the said housing, whereby any helically expanding said fluid being conducted by the said surface is imparted an accelerated, substantially annular, helically flowing axial motion.

14. A fluid control device, according to claim 10, in which a means for conducting fluid comprises:

(a) a single, continuously formed fluid conducting surface having substantially compound parabolic curvature of its transverse surface, posited so as to helically run the axial length of the said channel, the said conducting surface being affixed at its innermost edge to the said channel and unfixed at its outermost curves and edge, which said edge closely approaches the said housing at an angle to discharge downstream, whereby any said fluid escaping from the said channel is directed against an outer convex surface of a helical cone, diverged into helically expanding motion and conducted thusly toward the said housing and so discharged;

(b) the said outermost curve and edge of the said fluid conducting surface having curvilinear form so as to closely approach the said housing forming a continuous, helically running, substantially annular, narrowing aperture between the said edge and the said housing, whereby any helically expanding said fluid being conducted by the said surface is imparted an accelerated, substantially annular, helically flowing axial motion.

15. A fluid control device, according to claim 9, in which a silencer means comprises:

(a) a variably sized bushing, integrally formed with and longitudinally extending from the said main channel at its intake end, the said bushing serving as a means to affix the said device to the said source of exploding gases, whereby varying sources of exploding gases are encompassed and initially conducted into the said device;

(b) a substantially tubular, imperforate, longitudinally extending, vortex producing conduit, having a substantially annular series of edgeless, deeply grooved and seamless, endlessly helical inner surface rifling and being posited at and affixed to the said device at its final downstream end, whereby a tangentially sustained vortical motion is imparted all gases travelling through the said device and virtually silent ejection therefrom into ambient atmosphere is accomplished.

16. A fluid control device, according to claim 15, in which the silencer means further includes:

(a) a concentrically positioned, longitudinally extending, inner gas-permeable tubular member, butted against and affixed to the said main channel of the said device at its downstream end so as to permit smooth passage of a projectile through the said main channel and into the said tubular member, whereby the said channel and tubular member serve as a means to guide a projectile through the said device while propulsive gases are diverted essentially radially into the device and at the final said downstream end are diverted into the said conduit, rifling whereby vortical motion is imparted to the said gases for ejection into ambient atmosphere in virtual silence, and the said tubular member to vary in caliber and proportion as a means to make practical a full range of attachment applications, including to ordnance employing heavy explosive shells or small caliber hand-held weaponry, as well as to rocketry launching equipment.

17. A fluid control device, according to claim 15, in which, means for conducting exploding gases comprises:

(a) a single, continuously formed gas-conducting surface having generally compound parabolic curvature, positioned so as to helically run the axial length of the said channel, the said conducting surface being affixed at its innermost edge to the said channel and unfixed at its outermost edge, which said edge closely approaches the said housing at an angle to discharge downstream, whereby any said fluid escaping from the said channel is diverged into helically expanding motion and conducted thusly toward the said housing and discharged downstreamly;

(b) the said outermost edge of the said gas conducting surface having curvilinear form so as to closely approach the said housing, forming a continuous, helically running, substantially annular, narrowing aperture between the said edge and the said housing, whereby any helically expanding said fluid being conducted by the said surface is imparted an accelerated, substantially annular, helically flowing axial motion.

18. A fluid control device, according to claim 9, in which an exhaust silencer means further comprises:

(a) an impact-resisting, imperforate, essentially cylindrical protective outer shell, co-axial and concentrically posited outwardly with respect to the said housing being formed into at least two sections separating at an axially central diameter of the said shell, its wall being of heavy-gauge rigid material, its intake and exhaust ends tapering into compound parabolic curves narrowing to approximate an outside diameter of the said main channel, an exhaust and section of the said shell being fitted to and joining with the said housing at its said outlet conduit outside diameter at their mutual exhaust ends, an intake and section of the said shell fitted to the said intake channel at its intake end outside diameter and a center section of the shell enclosing and spaced from the main portion of the said housing;

(b) the said shell having a diameter sufficient to enclose the said housing and to form a space between both sufficient to serve as a dead-air space, the said shell being joined and sealed at its center by sealant means, whereby the said joining and sealant means render the said shell gas leakage-proof when assembled;

(c) an impact-returning and corrosion-resistant outer shell coating, said coating being bound to and forming an exterior surface of the said shell and composed of any of a number of suitable materials having the recited properties, whereby damage is eliminated from random impact or corrosion;

(d) an outer shell air-exhausting valve, said valve being inserted through the said shell, serving as means to exhaust air within the said dead-air space between the said shell and the said housing, whereby sound transmission by conduction from within the said device is interrupted and so virtually silenced;

(e) the said housing having three sections, an intermediate section being of largest diameter and essentially cylindrical, and intake and exhaust end sections each narrowing through compound parabolic curvature to approximate an outside diameter of the said main channel, being posited concentrically within the outer shell and enclosed by it, but intermediate between the said shell and longitudinally parallel to and radially outermost with relation to the said channel and deflecting surfaces and enclosing them, and three said sections joining by standard means, whereby inspection, repair, replacement, upgrading of new parts or original assembly is facilitated;

(f) a longitudinally extending imperforate, essentially tubular, integrally formed extension at its exhaust end of the said housing, approximating the diameter of the said main channel and forming a said outlet end bushing for connection with a means for exhaust conduction, whereby exhausting gases issuing from the said device are conducted to exit into ambient atmosphere;

(g) an intake end, imperforate, essentially tubular; said intake bushing, formed integrally with and extending longitudinally from the said main channel at its intake end and having a substantially annular raised shoulder portion positioned just inside an intake end interior surface wall of the said housing at its most narrow intake and approach to the said channel, whereby gas-tight sealing and butted fitting is effected with the said housing and shell assembly and the said main channel is affixed and secured, the said bushing also being a means for affixing the said device to any engine.

19. A fluid control device, according to claim 10, in which an exhaust silencer means further comprises:

(a) an impact-resisting, imperforate, essentially cylindrical protective outer shell, co-axial and concentrically positioned outwardly with respect to the said housing, the said outer shell being formed into at least two sections separating at an axially central diameter of the said shell, its wall being of heavy-gauge rigid material, its intake and exhaust ends tapering into compound parabolic curves narrowing to approximate an outside diameter of the said main channel, an exhaust end section of the said shell being fitted to and joining with the said housing at its said outlet conduit outside diameter at their mutual exhaust ends, an intake end section of the said shell being fitted to and joining with the said housing at its intake end outside diameter and being fitted to the said intake channel at its intake end outside diameter and a center section of the shell enclosing and being spaced from the main portion of the said housing;

(b) the said shell having a diameter sufficient to enclose the said housing and to form a space between both sufficient to serve as a dead-air space, the said shell being joined and sealed at its center by sealant means, whereby the said joining and sealant means render the said shell gas leakage-proof when assembled;

(c) an impact-returning and corrosion-resistant outer shell coating, said coating being bound to and forming an exterior surface of the said shell and composed of any of a number of suitable materials having the recited properties, whereby damage to internal parts of said device from random impact or corrosion is eliminated;

(d) an outer shell air-exhausting valve, said valve being inserted through the said shell, serving as means to exhaust air within the said dead-air space between the said shell and the said housing, whereby sound transmission by conduction from within the said device is interrupted and so virtually silenced;

(e) the said housing having three sections, an intermediate section being of largest diameter and essentially cylindrical, and intake and exhaust end sections each narrowing through compound parabolic curvature to approximate an outside diameter of the said main channel, being positioned concentrically within the outer shell and enclosed by it, but intermediate between the said shell and longitudinally parallel to and radially outermost with relation to the said channel and deflecting surfaces and enclosing them, and the three said sections joining by standard means, whereby inspection, repair, replacement, upgrading of new parts of original assembly is facilitated;

(f) a longitudinally extending imperforate, essentially tubular, integrally formed said outlet channel extension at its exhaust end of the said housing, approximating the diameter of the said main channel and forming a said outlet end bushing for connection with a means for exhaust conduction, whereby exhausting gases issuing from the said device are conducted to exit into ambient atmosphere;

(g) an intake end, imperforate, essentially tubular said intake bushing, formed integrally with and extending longitudinally from the said main channel at its intake end and having a substantially annular raised shoulder portion positioned just inside an intake end interior surface wall of the said housing at its most narrow intake end approach to the said channel, whereby gas-tight sealing and butted fitting is effected with the said housing and shell and the said main channel affixed and secured, the said bushing also being a means for affixing the said device to any engine.

* * * * *